US007750569B2

(12) United States Patent
Serita et al.

(10) Patent No.: US 7,750,569 B2
(45) Date of Patent: Jul. 6, 2010

(54) HIGH-FREQUENCY DISCHARGE LAMP INCORPORATING AN AUXILIARY STARTING ELECTRODE AND LAMP ATTACHMENT TO A COAXIAL WAVEGUIDE

(75) Inventors: Takuya Serita, Shizuoka (JP); Masaya Shido, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 814 days.

(21) Appl. No.: 11/705,845

(22) Filed: Feb. 13, 2007

(65) Prior Publication Data

US 2007/0194683 A1 Aug. 23, 2007

(30) Foreign Application Priority Data

Feb. 23, 2006 (JP) ..... 2006-047280

(51) Int. Cl.
*H01J 61/54* (2006.01)
*H01J 17/44* (2006.01)

(52) U.S. Cl. ..... 313/594; 313/234; 313/607; 313/110

(58) Field of Classification Search ..... 313/234, 313/607, 594, 110
See application file for complete search history.

(56) References Cited

U.S. PATENT DOCUMENTS 7,598,676 B2 * 10/2009 Serita et al. ..... 313/623

FOREIGN PATENT DOCUMENTS

JP 2005-228520 8/2005

* cited by examiner

*Primary Examiner*—Mariceli Santiago
(74) *Attorney, Agent, or Firm*—Osha • Liang LLP

(57) ABSTRACT

A high-frequency discharge lamp includes a coaxial waveguide including an internal conductor and a pipe-shaped external conductor surrounding said internal conductor, and a discharge tube including a ceramic or glass tube having an approximately ellipse spherical bulged part formed in a middle of a longitudinal direction, and both ends pinched and sealed; a conductor assembly sealed and attached to an end of the ceramic or glass tube; and an auxiliary electrode for starting disposed near the approximately ellipse spherical bulged part. A rare gas for starting with 1 atmospheric pressure or more at room temperature together with a light emission substance is enclosed inside of the approximately ellipse spherical bulged part. The discharge tube is inserted conductor assembly end first and held in a top opening of the coaxial waveguide. A high-voltage pulse generated by a high-voltage pulse generator is applied to the auxiliary electrode through a pulse transmission line.

19 Claims, 15 Drawing Sheets

HIGH-FREQUENCY DISCHARGE LAMP INCORPORATING AN AUXILIARY STARTING ELECTRODE AND LAMP ATTACHMENT TO A COAXIAL WAVEGUIDE

BACKGROUND OF INVENTION

1. Field of the Invention

The present invention relates to a high-frequency discharge lamp comprising a high-frequency discharge tube for emitting light of discharge by plasma generated by high-frequency electromagnetic waves transmitted by a coaxial waveguide constructed of an internal conductor and an external conductor.

2. Background Art

FIGS. 14 and 15 are a conventional high-frequency discharge lamp shown in the following Patent Reference 1, and comprise a coaxial waveguide 1 for high-frequency electromagnetic wave transmission constructed of an internal conductor 2 and an external conductor 3, and a discharge tube 4 which is attached to the top of the waveguide 1 and emits light of discharge by plasma generated by electromagnetic waves transmitted by the waveguide 1 and has an outside diameter almost equal to an outside diameter of the waveguide 1. That is, the top of the waveguide 1 for transmitting high-frequency electromagnetic waves generated by a sending part is provided with an electromagnetic wave irradiation part 6 comprising an internal conductor 6*a* and an external conductor 6*b* respectively connected to the internal conductor 2 and the external conductor 3 of the waveguide 1. Electromagnetic waves (a high-frequency electric field generated by the electromagnetic wave irradiation part 6) are irradiated from an annular top plate part 6*b*1 of the external conductor 6*b* and a disk-shaped top part 6*a*1 of the internal conductor 6*a* opposed with an annular slit 6*c* sandwiched between the parts. High-density plasma is generated inside the discharge tube 4 and a light emission substance of the inside of the discharge tube 4 is evaporated and excited and emits light.

Since an electrode is not disposed inside discharge space of the discharge tube 4, there is no heat loss from the electrode and light emission efficiency (lumen/watt) of the discharge tube improves accordingly and it is unnecessary to consider a reaction between a conductor assembly and an enclosure substance (a metal halide) of the inside of the discharge space, so that a light emission substance suitable to improve the light emission efficiency can be used.

[Patent Reference 1] JP-A-2005-228520

However, in the conventional art described above, when a pressure of a rare gas for starting enclosed with the inside of the discharge tube 4 (discharge space) is increased, a density of plasma generated in the discharge space becomes high and the amount of light increases, but a starting onset voltage rises with an increase in the pressure of the rare gas and starting (lighting) cannot be performed, so that an enclosure pressure of the rare gas is set at less than 1 atmospheric pressure at room temperature and as a result of this, the plasma density does not increase and a sufficient amount of light cannot be obtained.

Further, since electromagnetic waves are guided to the discharge space through a bottom wall of the discharge tube 4, Joule loss by heating of the bottom wall is large and the bottom wall of the discharge tube 4 is arranged so as to make contact with a top surface (the disk-shaped top part 6*a*1 of the internal conductor 6*a* and the annular top plate part 6*b*1 of the external conductor 6*b*) of the electromagnetic wave irradiation part 6 with a large heat capacity, so that loss by heat conduction is large and light emission efficiency does not increase.

Also, the discharge tube 4 is a bottomed cylindrical body with a large surface area and has large loss of heat radiation from the tube surface and has less efficiency of light emission and further is not realistic in the case of considering a process of manufacturing the discharge tube.

SUMMARY OF INVENTION

Therefore, an inventor first considered the possibilities of applying a basic structure of a high-intensity discharge tube (arc tube) which is widely used as a light source of a head lamp etc. for automobile and has a high enclosure pressure of a rare gas for starting of the inside of discharge space. That is, the inventor determined that when the enclosure pressure of the rare gas for starting of the inside of discharge space is high, a vapor pressure of a light emission substance becomes high and a sufficient amount of light can be obtained and when a manufacturing process of the high-intensity discharge tube (arc tube) is used, manufacture is also easy.

However, because the discharge space becomes a high-pressure ambience, a discharge start voltage becomes high and starting (lighting) cannot be performed or time taken to perform starting (lighting) becomes long, though a desired amount of light can be obtained. Thus, it was determined that this cannot be used as a light source of a head lamp etc. for automobile requiring that lighting can surely be performed again in all conditions.

Therefore, the inventor determined that when a high-voltage pulse is applied to an electrode disposed in the vicinity of discharge space, an electric field is generated in the periphery of the electrode and discharge is instantly started inside the discharge space.

Accordingly, one or more embodiments of invention provide a high-frequency discharge lamp with good starting performance, comprising a discharge tube for emitting light of discharge by plasma generated by high-frequency electromagnetic waves transmitted by a coaxial waveguide, the discharge tube having good efficiency of light emission and being easy to manufacture.

In one or more embodiments, in a high-frequency discharge lamp comprising a coaxial waveguide for high-frequency electromagnetic wave transmission constructed of an internal conductor and a pipe-shaped external conductor surrounding the internal conductor, and a discharge tube which is attached to the top of the waveguide and emits light of discharge by plasma generated by electromagnetic waves, it is constructed so that the discharge tube is constructed in a double end shape in which both ends of a ceramic tube or a glass tube in which an approximately ellipse spherical bulged part is formed in the middle of a longitudinal direction are sealed and attached and thereby a conductor assembly is sealed and attached (fixed) to at least a proximal side seal attachment part and a rare gas for starting with 1 atmospheric pressure or more at room temperature together with a light emission substance is enclosed with the inside of the approximately ellipse spherical bulged part, and an electromagnetic wave irradiation part is constructed by the conductor assembly and the external conductor top of the waveguide surrounding the conductor assembly by inserting and holding the proximal side seal attachment part of the discharge tube in a top opening of the waveguide so that the conductor assembly approaches the internal conductor of the waveguide and also, an auxiliary electrode for starting to which a high-voltage pulse generated by a high-voltage pulse generator is applied through a pulse transmission line is disposed in the vicinity of the approximately ellipse spherical bulged part of the discharge tube.

In addition, there are cases where a discharge tube is constructed of a quartz glass tube and is constructed of a ceramic tube and in the case of constructing the discharge tube of the quartz glass tube, it is desirable that a conductor assembly in which a conductor bar and molybdenum foil are linearly connected and integrated should be sealed and attached (fixed) to at least a proximal side pinch seal part of pinch seal parts of both ends of the quartz glass tube. That is, a seal attachment part of the quartz glass tube is constructed of a pinch seal part.

On the other hand, in the case of constructing the discharge tube of the ceramic tube, it is desirable that conductor assemblies should be sealed and attached and fixed to narrow tube parts of both ends of the ceramic tube by respectively welding (molybdenum conductor bars of) conductor assemblies in which a tungsten conductor bar and a molybdenum conductor bar are linearly connected and integrated to the ends of molybdenum pipes metallized and joined to the inner peripheries of the narrow tube parts of both ends of the ceramic tube or respectively glass-welding (molybdenum conductor bars or niobium conductor bars of) conductor assemblies in which a tungsten conductor bar and a molybdenum conductor bar (or a niobium conductor bar) are linearly connected and integrated to the ends of the narrow tube parts of both ends of the ceramic tube. That is, a seal attachment part of the ceramic tube is constructed of a weld part and a molybdenum pipe or is constructed of a glass weld part.

The inside of discharge space of the inside of an approximately ellipse spherical bulged part is irradiated with electromagnetic waves transmitted by a coaxial waveguide from an electromagnetic wave irradiation part constructed by a first conductor assembly sealed and attached to a proximal side seal attachment part of a discharge tube and the external conductor top of the waveguide surrounding the first conductor assembly. By the irradiated electromagnetic waves (a high-frequency electric field generated by the electromagnetic wave irradiation part), high-density plasma is generated inside the discharge space and a light emission substance of the inside of the discharge space is evaporated and excited and emits light. Particularly, a rare gas for starting with 1 atmospheric pressure or more at room temperature together with a light emission substance is enclosed with the inside of the discharge space, and a vapor pressure of the light emission substance etc. is increased and a plasma density becomes high and accordingly, a large amount of light can be obtained by discharge light emission.

However, since a pressure (gas pressure) of the inside of discharge space is higher than that of a discharge tube of the conventional art, a discharge start voltage increases, so that only irradiation with electromagnetic waves from the electromagnetic wave irradiation part does not start discharge and cannot make a shift to lighting. Therefore, in the case of applying a high-voltage pulse to an auxiliary electrode for starting arranged in the vicinity of the approximately ellipse spherical bulged part concurrently with irradiation with electromagnetic waves from the electromagnetic wave irradiation part, even when the pressure (gas pressure) of the inside of the discharge space is 1 atmospheric pressure or more at room temperature, a gas is ionized by a high electric field generated in the periphery of the electrode and high-density plasma is generated by generated electrons and it shifts to generation of high-density plasma by a high-frequency electric field generated by the electromagnetic wave irradiation part constructed of the first conductor assembly and the external conductor top of the waveguide. That is, discharge is instantly started in the discharge space.

Also, since electromagnetic waves transmitted by the waveguide are guided to the discharge space through the first conductor assembly sealed and attached to the proximal side seal attachment part of the discharge tube, as compared with the conventional structure of being guided through a quartz glass surface, Joule loss in the electromagnetic wave irradiation part becomes small by the amount of elimination of Joule loss by quartz glass and light emission efficiency of the discharge tube increases.

Also, in the approximately ellipse spherical bulged part forming an light emission part, as compared with the conventional bottomed cylindrical shape, the tube wall temperature is kept constant (only a part does not increase to high temperature and the tube wall temperature is smoothed over the whole tube wall) and devitrification or a bulge is suppressed and also the minimum temperature of the tube wall increases and light emission efficiency of the discharge tube improves.

Also, when a conductor assembly (second conductor assembly) is sealed and attached to a distal side pinch seal part of the discharge tube, the second conductor assembly acts as an antenna and a high electric field also concentrates on the periphery of the second conductor assembly, so that an arc converges toward the second conductor assembly and the arc (shape) becomes stable. Particularly, in the case of being used as a light source of an automobile lamp such as a head lamp, a discharge tube is used in a form of horizontal lighting and the arc (shape) becomes stable, so that a shape of the discharge tube (tube wall) can be designed so as to become an optimum shape in which the arc does not make contact with the tube wall and this leads to an improvement in light emission efficiency.

Also, a high-intensity discharge tube (arc tube) widely used as a light source of a head lamp etc. for automobile is constructed in a double end shape in which both ends of a ceramic tube or a glass tube in which an approximately ellipse spherical bulged part is formed in the middle of a longitudinal direction are sealed and attached and thereby electrode assemblies are sealed and attached to seal attachment parts of both ends and a rare gas for starting together with a light emission substance is enclosed with the inside of the approximately ellipse spherical bulged part, and a "discharge tube constructed in a double end shape in which both ends of a ceramic tube or a glass tube in which an approximately ellipse spherical bulged part is formed in the middle of a longitudinal direction are sealed and attached and thereby a conductor assembly is sealed and attached to at least a proximal side seal attachment part and discharge space in which a rare gas for starting with 1 atmospheric pressure or more at room temperature together with a light emission substance is enclosed with the inside of the approximately ellipse spherical bulged part is had" can be manufactured by using manufacturing equipment of this high-intensity discharge tube (arc tube).

In one or more embodiments, the starting auxiliary electrode is constructed by a conductor assembly sealed and attached to a distal side seal attachment part of the discharge tube in the high-frequency discharge lamp.

A conductor assembly (second conductor assembly) sealed and attached to a distal side seal attachment part of a discharge tube functions as an antenna for concentrating an electric field and also functions as an auxiliary electrode for starting for guiding a high-voltage pulse to discharge space, so that starting performance of a high-frequency discharge lamp can be increased without newly adding the auxiliary electrode for starting in the vicinity of an ellipse spherical bulged part of the discharge tube.

In one or more embodiments, the auxiliary electrode for starting is constructed by a conductor assembly sealed and attached to a proximal side seal attachment part of the discharge tube in the high-frequency discharge lamp.

A conductor assembly sealed and attached to a proximal side seal attachment part of the discharge tube functions as an electromagnetic wave irradiation part together with the external conductor top of a waveguide (functions as a guide part for guiding high-frequency electromagnetic waves to discharge space) and also functions as an auxiliary electrode for starting to which a high-voltage pulse is applied, so that starting performance of a high-frequency discharge lamp can be increased without newly adding the auxiliary electrode for starting in the vicinity of an ellipse spherical bulged part of the discharge tube.

In one or more embodiments, it is constructed so that the ellipse spherical bulged part is covered with hermetically sealed space defined by a cylindrical shroud for ultraviolet shielding integrally welded to the seal attachment part in the high-frequency discharge lamp.

A shroud for covering an ellipse spherical bulged part which is a light emission part has action of blocking ultraviolet rays of a wavelength range harmful to the human body. Also, the hermetically sealed space defined by the shroud acts as an insulation layer of the periphery of the ellipse spherical bulged part, and heat dissipation from the ellipse spherical bulged part to the outside is suppressed.

In one or more embodiments, it is constructed so that a gas capable of assisting discharge, the gas with less than 1 atmospheric pressure at room temperature, is enclosed with the inside of the hermetically sealed space surrounding the ellipse spherical bulged part defined by the shroud in the high-frequency discharge lamp.

When a high-voltage pulse is applied to an auxiliary electrode for starting, a gas capable of assisting discharge such as a nitrogen gas or an inert gas having a discharge start voltage lower than a discharge start voltage of the inside of discharge space starts discharge by a high electric field generated in the periphery of the electrode and the inside of a discharge tube (discharge space) is irradiated with ultraviolet rays emitted by this discharge and thereby a rare gas for starting of the inside of the discharge tube (discharge space) is ionized and the discharge is started. That is, before a start of the discharge of the inside of the discharge space, discharge of the inside of the hermetically sealed space in the shroud is started, so that a discharge lamp can be started surely by a lower pulse voltage.

In one or more embodiments, it is constructed so that the discharge tube is constructed of a quartz glass tube and the seal attachment part is constructed of a pinch seal part and a part of the conductor assembly sealed and attached to at least the proximal side pinch seal part among a pair of the pinch seal parts is protruded to the inside of the discharge space in the high-frequency discharge lamp.

Since electromagnetic waves transmitted by a coaxial waveguide are surely guided to discharge space through a first conductor assembly protruding to the inside of the discharge space, Joule loss in an electromagnetic wave irradiation part becomes smaller and light emission efficiency of a discharge tube made of quartz glass increases more.

According to a high-frequency discharge lamp in accordance with one or more embodiments, a high-frequency discharge lamp with good starting performance, comprising a discharge tube in which light emission efficiency is improved can be provided.

Also, a discharge tube for emitting light of discharge by plasma generated by electromagnetic waves can be simply manufactured without separately developing new manufacturing equipment by applying the manufacturing equipment of a high-intensity discharge tube (arc tube) widely used as a light source of a head lamp etc. for automobiles.

According to one or more embodiments, a conductor assembly (second conductor assembly) which is an antenna sealed and attached to a distal side seal attachment part of a discharge tube also functions as an auxiliary electrode for starting for guiding a high-voltage pulse to discharge space, so that a high-frequency discharge lamp with good starting performance and a simple structure can be provided.

According one or more embodiments, a conductor assembly for high-frequency electromagnetic wave guiding sealed and attached to a proximal side seal attachment part of a discharge tube also functions as an auxiliary electrode for starting to which a high-voltage pulse is applied, so that a high-frequency discharge lamp with good starting performance and a simple structure can be provided.

According one or more embodiments, a temperature of the inside of discharge space of a discharge tube is held at high temperature, so that a high-frequency discharge lamp comprising a discharge tube in which light emission efficiency is furthermore improved can be provided.

According one or more embodiments, discharge is started inside a shroud (inside hermetically sealed space) before a start of discharge of the inside of discharge space, so that a high-frequency discharge lamp with better starting performance can be provided.

According one or more embodiments, a high-frequency discharge lamp comprising a discharge tube made of quartz glass in which light emission efficiency is more improved can be provided.

Other aspects and advantages of the invention will be apparent from the following description and the appended claims.

BRIEF DESCRIPTION OF DRAWINGS

FIG. 1(*a*) is an enlarged perspective view of discharge tube fixing and holding means which is a main part of the same discharge lamp.

DETAILED DESCRIPTION

Next, embodiments of the invention will be described based on examples.

Figure 1:
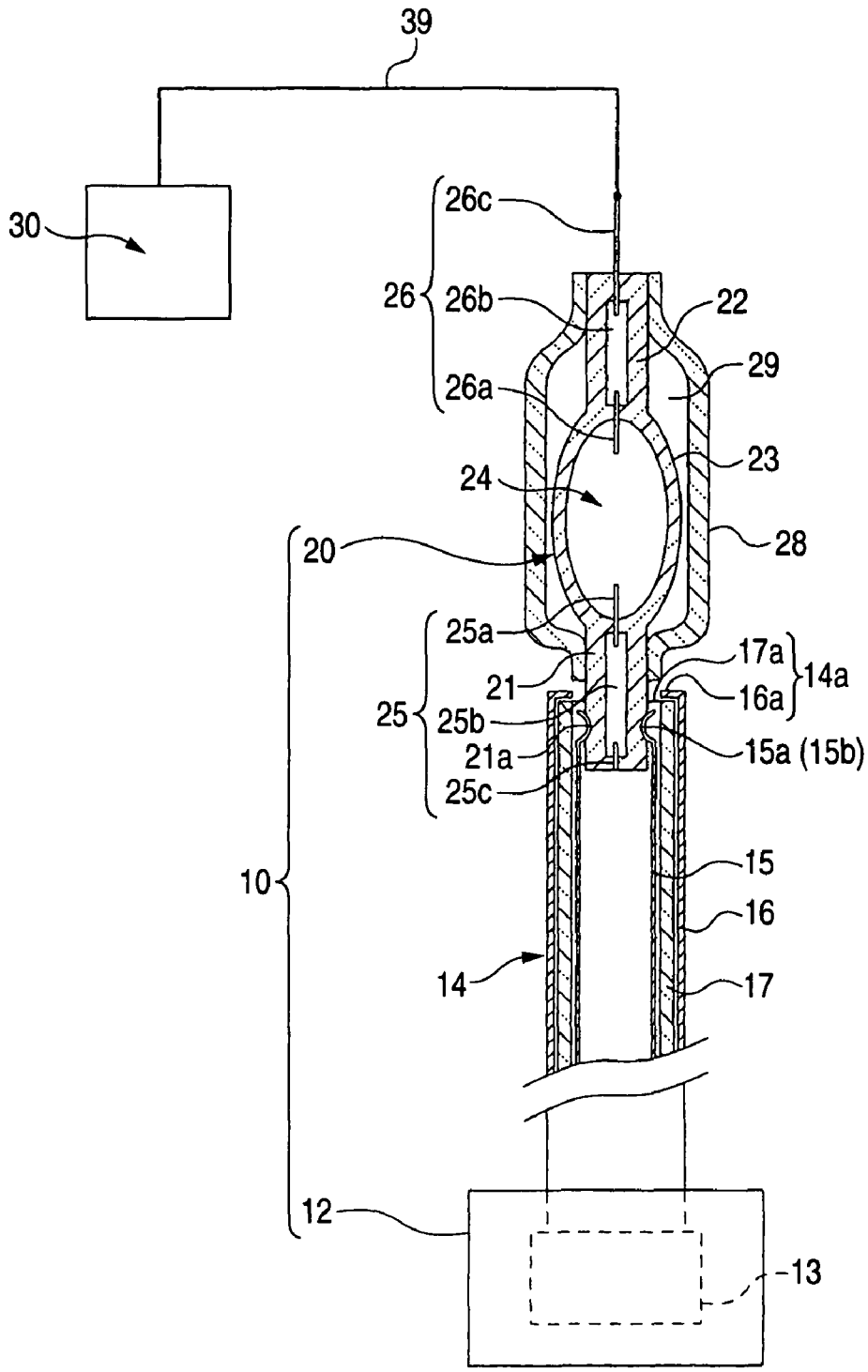
FIG. 1 is a longitudinal sectional view showing an outline of a discharge lamp which is a first embodiment of the invention.
Figure 1:
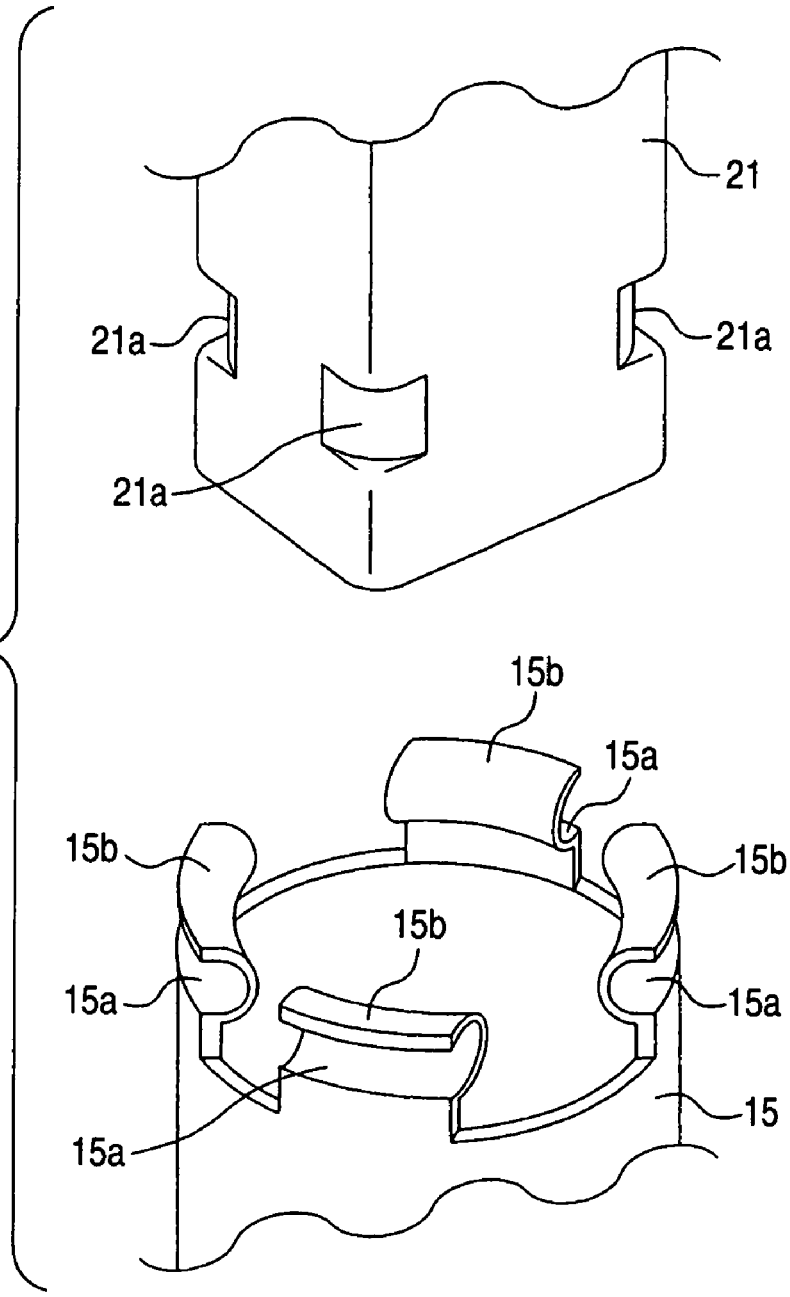
Figure 2:
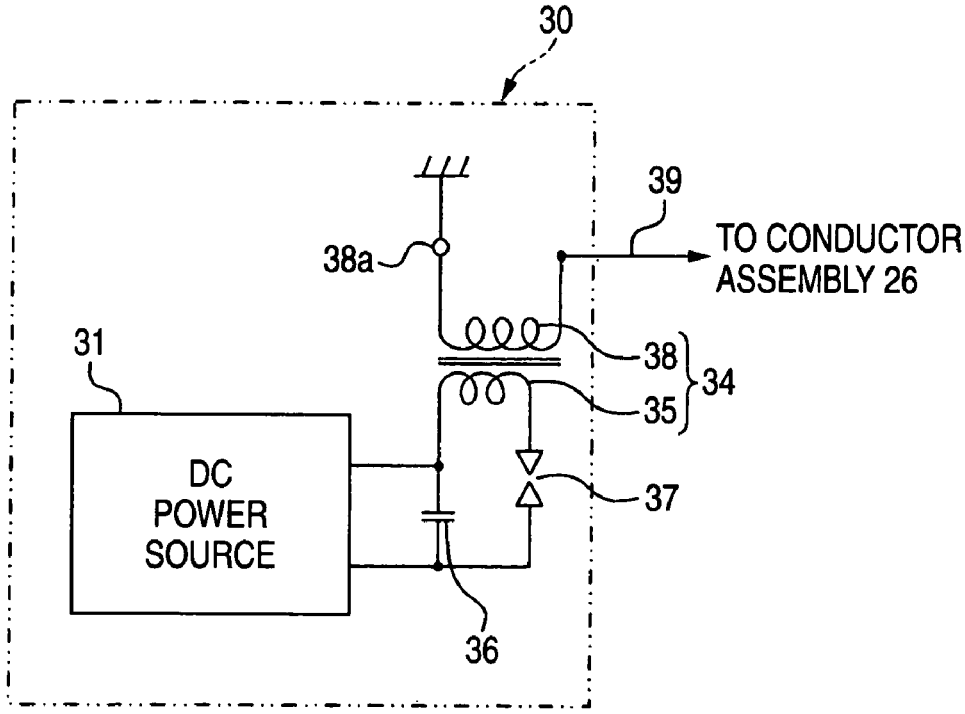
FIG. 2(*a*) is a diagram showing a configuration of a high-voltage pulse generator, and FIG. 2(*b*) is a diagram showing a pulse generated by the same high-voltage pulse generator.
Figure 2:
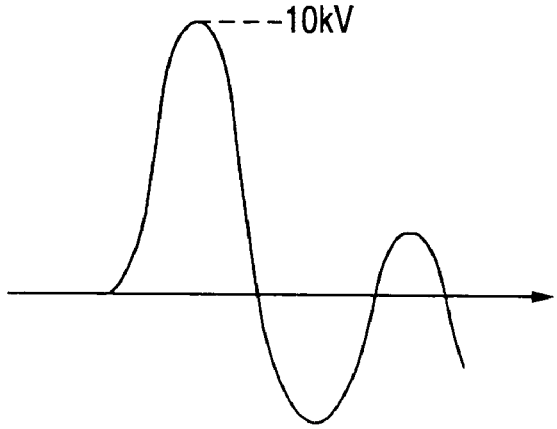

FIGS. 1, 1(*a*) and 2 show a high-frequency discharge lamp which is a first embodiment of the invention, and FIG. 1 is a longitudinal sectional view showing the whole outline of the same discharge lamp, and FIG. 1(*a*) is an enlarged perspective view of discharge tube fixing and holding means which is a main part of the same discharge lamp, and FIG. 2(*a*) is a diagram showing a configuration of a high-voltage pulse generator, and FIG. 2(*b*) is a diagram showing a high-voltage pulse generated by the high-voltage pulse generator.

In FIG. 1, a discharge lamp 10 comprises a power source part 12 for generating high-frequency electromagnetic waves, a waveguide 14 for transmitting the electromagnetic waves generated by the power source part 12, and a discharge tube 20 for emitting light of discharge by the electromagnetic waves transmitted by the waveguide 14.

The power source part 12 comprises a sending part 13 for generating electromagnetic waves of a microwave band (1 to 100 GHz) by electric power supplied from a vehicle-mounted battery, and the sending part 13 is constructed of a high-frequency amplifier using, for example, a magnetron or a semiconductor switching element (an FET, a bipolar transistor, etc.).

The waveguide 14 has a structure in which a circular pipe-shaped internal conductor 15 made of metal, a circular pipe-shaped external conductor 16 made of metal surrounding this internal conductor 15 and a dielectric 17 made of quartz glass which is an insulating member interposed between both the conductors 15, 16 and is formed in a circular pipe shape are coaxially integrated, and electromagnetic waves are transmitted between the internal conductor 15 and the external conductor 16 surrounding this internal conductor.

The discharge tube 20 is constructed in a double end shape in which both ends of a glass (anhydrous quartz glass) tube in which an ellipse spherical bulged part 23 is formed in the middle of a longitudinal direction are pinched and sealed and thereby conductor assemblies 25, 26 are sealed and attached to pinch seal parts 21, 22 and the inside of the ellipse spherical bulged part 23 forms discharge space 24.

A rare gas (1 to 20 atmospheric pressures at room temperature) for starting together with a light emission substance (NaI, $ScI_3$, etc.) is enclosed with the inside of the ellipse spherical bulged part 23 (discharge space 24) of the discharge tube 20, and the conductor assembly 25 in which a tungsten-made conductor bar 25*a* and a molybdenum-made conductor bar 25*c* are linearly connected and integrated through rectangular molybdenum foil 25*b* is sealed and attached (fixed) to the proximal side pinch seal part 21. The tungsten-made conductor bar 25*a* protrudes to the inside of the discharge space 24 by a predetermined length and the molybdenum-made conductor bar 25*c* is exposed flush with a top surface of the pinch seal part 21. On the other hand, the conductor assembly 26 in which a tungsten-made conductor bar 26*a* and rectangular molybdenum foil 26*b* are linearly connected and integrated is sealed and attached (fixed) to the distal side pinch seal part 22 of the discharge tube 20, and the tungsten-made conductor bar 26*a* protrudes to the inside of the discharge space 24 by a predetermined length (the same length as the protrusion length of the conductor bar 25*a*) and the molybdenum foil 26*b* is exposed flush with a top surface of the pinch seal part 22.

The tungsten-made conductor bars 25*a*, 26*a* constructing the conductor assemblies 25, 26 are constructed of, for example, a thoria-doped tungsten wire or a potassium-doped tungsten wire with an outside diameter of 0.25 mm, and the molybdenum foils 25*b*, 26*b* are formed in, for example, a thickness of 20 μm. The molybdenum foils 25*b*, 26*b* are compatible with glass and a thermal expansion difference between the conductor assemblies 25, 26 and a glass (quartz glass) layer in the pinch seal parts 21, 22 is accommodated by the molybdenum foils 25*b*, 26*b* and occurrence of cracking in (the glass layer of) the pinch seal parts 21, 22 is suppressed and lighting failure can be prevented.

Also, transverse sectional areas of the molybdenum foils 25*b*, 26*b* are smaller than transverse sectional areas of the tungsten-made conductor bars 25*a*, 26*a*, so that heat conduction as the whole of the conductor assemblies 25, 26 is suppressed and loss by the heat conduction in the conductor assemblies 25, 26 is small.

In addition, it is desirable that a thickness (outside diameter) of the tungsten-made conductor bars 25*a*, 26*a* be in the range from 0.10 to 0.40 mm, and it is checked that light emission efficiency of the discharge tube 20 is higher as the thickness (outside diameter) becomes thin (small).

Also, in one or more embodiments, the discharge tube 20 is lit using lighting electric power of 30 W, and it is checked that light emission efficiency similar to that of the present embodiment can be obtained by increasing the ellipse spherical bulged part 23 of the discharge tube 20 (increasing the cubic capacity of the discharge space 24) in the case of increasing the lighting electric power.

The discharge tube 20 is surrounded by a cylindrical shroud 28 for ultraviolet shielding whose ends are welded to the pinch seal parts 21, 22. The shroud 28 is constructed of quartz glass to which metal such as titanium having action of blocking ultraviolet rays of a wavelength range harmful to the human body is added, and has action of blocking ultraviolet rays harmful to the human body included in discharge light emission of the discharge tube 20. That is, when it is attempt to construct the discharge tube 20 of quartz glass to which metal having ultraviolet blocking action is added, a processing temperature of a glass tube increases or the discharge tube cannot be used because of a reaction (influence on light emission) between the added metal and an enclosure substance, and the discharge tube 20 is constructed of anhydrous quartz glass without the ultraviolet blocking action. Then, the ellipse spherical bulged part 23 of the discharge tube 20 is constructed so as to be covered with the shroud 28 for ultraviolet shielding in order to avoid an adverse influence on the human body or damage to a resin-made lamp component by radiation of ultraviolet rays. Also, it is useful to add alumina ($Al_2O_3$) to quartz glass constructing the shroud 28 in order to prevent a deterioration of life performance characteristics by Na leakage.

Also, the inside of the shroud 28 (the periphery of the discharge tube 20) is constructed so that light emission efficiency of the discharge tube 20 improves by forming hermetically sealed space 29 filled with an inert gas or vacuumized and suppressing heat dissipation from the discharge tube 20 by the hermetically sealed space 29 which is a heat insulation layer. In addition, the inert gas etc. enclosed with the inside of the shroud 28 (hermetically sealed space 29) are preferably a substance with heat insulation properties higher than those of air and, for example, the cases of enclosing a single gas of $N_2$, Xe or Ar or enclosing a mixed gas such as $N_2$+Ar, $N_2$+Xe or Ar+Ne are contemplated. Also, the inert gas etc. enclosed with the inside of the shroud 28 (hermetically sealed space 29) act as an auxiliary dischargeable gas and will be described below in detail and are effective in improving starting performance (early lighting).

Also, an opening 14*a* in which the proximal side pinch seal part 21 of the discharge tube 20 can be inserted and held is disposed in the top of the waveguide 14.

The opening 14*a* is constructed of an annular front edge part 16*a* of the circular pipe-shaped external conductor 16 and a top opening 17*a* of the circular pipe-shaped dielectric 17, and tongue-shaped pinch pieces 15*a* which are discharge tube fixing and holding means disposed in the top of the circular pipe-shaped internal conductor 15 are arranged inside the circular pipe-shaped dielectric 17. That is, as shown in FIG. 1(*a*), while circular arc-shaped recessed grooves 21*a* are formed in four corners of the rectangular proximal side pinch seal part 21 in the discharge tube 20, four tongue-shaped pinch pieces 15*a* are formed in the top of the circular pipe-shaped internal conductor 15 as opposed to four corners of the pinch seal part 21 and also circular arc-shaped latch parts 15*b* capable of engaging with the recessed grooves 21*a* of the pinch seal part 21 are formed in the top sides of the pinch pieces 15*a*.

Then, when the proximal side pinch seal part 21 of the discharge tube 20 is inserted in the top opening 14*a* of the waveguide 14 (the top opening 17*a* of the dielectric 17), it is constructed so that the top of the proximal side pinch seal part 21 is inserted with the tongue-shaped pinch pieces 15*a* of the internal conductor 15 pushed and the latch parts 15*b* of the tongue-shaped pinch pieces 15*a* engage with the recessed grooves 21*a* of the pinch seal part 21 and thereby the pinch seal part 21 is gripped (pinched) in the tongue-shaped pinch pieces 15*a* and is positioned and fixed and held in axial and circumferential directions (the discharge tube 20 is retained and fixed and held in the top opening 14*a* of the waveguide 14) and also the conductor assembly 25 (molybdenum-made conductor bar 25*c*) approaches the internal conductor 15.

As a result of this, the inside of the discharge space 24 is irradiated with high-frequency electromagnetic waves transmitted by the waveguide 14 by the conductor assembly 25 sealed and attached to the proximal side pinch seal part 21 and the annular front edge part 16*a* of the external conductor 16 surrounding this conductor assembly 25. At this time, by the irradiated electromagnetic waves (a high-frequency electric field generated by an electromagnetic wave irradiation part), high-density plasma is generated inside the discharge space 24 and a light emission substance of the inside of the discharge space 24 is evaporated and excited and emits light. That is, the electromagnetic wave irradiation part for irradiating the discharge space 24 with electromagnetic waves is constructed by the conductor assembly 25 and the annular front edge part 16*a* of the external conductor 16 surrounding this conductor assembly 25, and the top of the waveguide 14 functions as a launcher for guiding electromagnetic waves to the discharge tube 20.

Particularly, the tungsten-made conductor bar 25*a* of the conductor assembly 25 constructing the electromagnetic wave irradiation part protrudes to the inside of the discharge space 24, so that electromagnetic waves transmitted by the waveguide 14 are naturally guided to the inside of the discharge space 24 surely through the conductor bar 25*a* and as compared with the case of guiding electromagnetic waves through a quartz glass surface as shown in the conventional art, there is no Joule loss by quartz glass, so that the Joule loss in the electromagnetic wave irradiation part is small and light emission efficiency of the discharge tube 20 improves accordingly.

Also, the conductor assembly 26 sealed and attached to the distal side pinch seal part 22 of the discharge tube 20 acts as an antenna and a high electric field also concentrates on the periphery of the conductor assembly 26, so that an arc converges toward the conductor assembly 26 and the arc (shape) becomes stable. Particularly, in the case of being used as a light source of an automobile lamp such as a head lamp, a discharge tube 20 is used in a form of horizontal lighting and the arc (shape) becomes stable, so that a shape of the discharge tube (tube wall) can be designed so as to become an optimum shape in which the arc does not make contact with the tube wall and this leads to an improvement in light emission efficiency.

Figure 15:
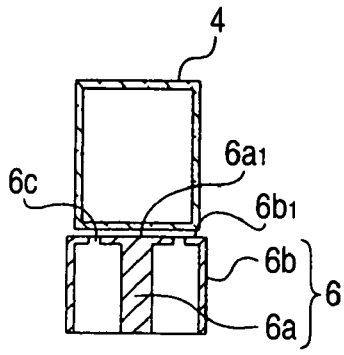
FIG. 15 is a longitudinal sectional view of a discharge tube which is a main part of the same discharge lamp.

Also, in one or more embodiments, the proximal side pinch seal part 21 of the discharge tube 20 is attached to the top of the waveguide 14, and an area of contact between the discharge tube 20 and the waveguide 14 is limited to a pinch (grip) region by the tongue-shaped pinch pieces 15*a* which are the fixing and holding means among the outer periphery of the pinch seal part 21, so that the area of contact is smaller than that of the conventional structure and loss by heat conduction is small. Further, a surface area of the ellipse spherical bulged part 23 forming a light emission part of the discharge tube is smaller than that of the conventional bottomed cylindrical body (see FIG. 15) and loss of heat radiation from the tube wall is small, so that light emission efficiency of the discharge tube 20 increases.

Also, in the ellipse spherical bulged part 23 forming the light emission part, as compared with the conventional bottomed cylindrical shape, the tube wall temperature is kept constant (only a part does not increase to high temperature and the tube wall temperature is smoothed over the whole tube wall) and devitrification or a bulge is suppressed and also the minimum temperature of the tube wall increases and light emission efficiency of the discharge tube 20 improves.

Numeral 30 in FIG. 1 is a high-voltage pulse generator comprising a DC power source 31 constructed of a vehicle-mounted battery etc. (see FIG. 2(*a*)), and a starting auxiliary apparatus for increasing starting performance (speeding up a start of discharge light emission) is constructed by this high-voltage pulse generator 30, a lead wire 39 which is a pulse transmission line for transmitting a high-voltage pulse generated by the pulse generator 30 and the conductor assembly 26 which is an auxiliary electrode for starting to which the transmitted high-voltage pulse is applied.

A configuration of the high-voltage pulse generator 30 is shown in FIG. 2(*a*), and a capacitor 36 is connected in parallel with a primary coil 35 of a transformer 34 connected between (a positive electrode and a negative electrode of) the DC power source 31 and also a spark gap 37 is connected in series with the primary coil 35. One end side 38*a* of a secondary coil 38 of the transformer 34 is grounded and also the other end side is connected to the auxiliary electrode for starting (conductor assembly 26) of the inside of the discharge tube 20 through the lead wire 39. Discharge is generated in the spark gap 37 every time an electric charge accumulates in the capacitor 36 and a high voltage (for example, 10 KV) generated in the secondary coil 38 at this time is applied to the auxiliary electrode for starting (conductor assembly 26) through the lead wire 39 as a high-voltage pulse shown in FIG. 2(*b*).

That is, a rare gas for starting with 1 atmospheric pressure or more at room temperature together with a light emission substance is enclosed with the inside of the discharge space 24, and a vapor pressure of the light emission substance etc. is increased and a plasma density becomes high and accordingly, a large amount of light can be obtained by discharge light emission.

However, since a pressure (gas pressure) of the inside of the discharge space 24 is higher than that of a discharge tube of the conventional art, a discharge start voltage increases, so that only irradiation with electromagnetic waves from the electromagnetic wave irradiation part does not start discharge and cannot make a shift to lighting. Therefore, by applying a high-voltage pulse to the auxiliary electrode for starting (conductor assembly 26) protruding to the inside of the discharge space 24 concurrently with irradiation with electromagnetic waves from the electromagnetic wave irradiation part, even when the pressure (gas pressure) of the inside of the discharge space 24 is 1 atmospheric pressure or more at room temperature, a high electric field is generated in the periphery of the electrode (conductor assembly 26) and the rare gas for starting is ionized by this high electric field and high-density plasma is generated by electrons generated at this time and it shifts to generation of high-density plasma by a high-frequency electric field generated by the electromagnetic wave irradiation part constructed of the conductor assembly 25 and the external conductor top 16*a* of the waveguide 14 and discharge is instantly started in the discharge space 24. As a result, time taken to start the discharge after turning on lighting electric power is reduced.

In one or more embodiments, the conductor assembly 26 acting as an antenna for concentrating a high electric field and stabilizing an arc (shape) also functions as the auxiliary electrode for starting of the starting auxiliary apparatus for increasing starting performance (speeding up a start of discharge light emission), so that starting performance of the discharge lamp can be increased without separately adding the auxiliary electrode for starting in the vicinity of the discharge tube 20.

Also, an inert gas etc. enclosed with the inside of the shroud 28 (hermetically sealed space 29) act as an auxiliary dischargeable gas and are effective in more improving the starting performance (early lighting) of the discharge lamp.

That is, when a high-voltage pulse is applied to the auxiliary electrode for starting (conductor assembly 26), a gas capable of assisting discharge such as a nitrogen gas or an inert gas having a discharge start voltage lower than a discharge start voltage of the inside of the discharge space 24 starts discharge by a high electric field generated in the periphery of the electrode (conductor assembly 26) and the inside of the discharge space 24 is irradiated with ultraviolet rays emitted by this discharge and thereby a rare gas for starting of the inside of the discharge space 24 is ionized and the discharge is started. Thus, before a start of the discharge of the inside of the discharge space 24, discharge of the inside of the hermetically sealed space 29 in the shroud 28 is started, so that the discharge lamp can be started surely by a lower pulse voltage. As a result, the time taken to start the discharge after turning on lighting electric power is further reduced.

Figure 3:
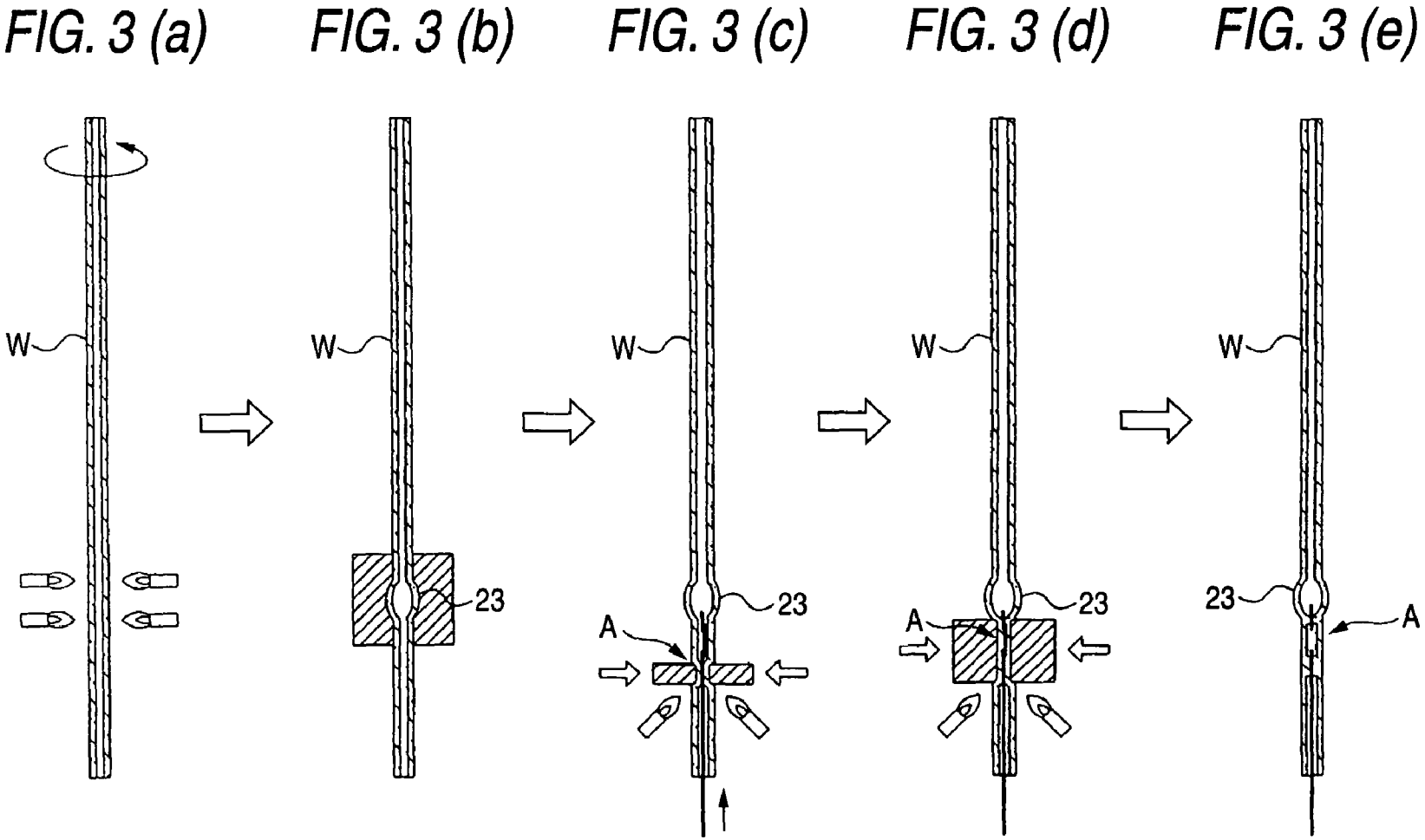
FIG. 3 is views explaining the first half of a manufacturing process of a discharge tube, and 3(*a*) and 3(*b*) are views showing a process of molding an ellipse spherical bulged part, and 3(*c*) and 3(*d*) are views showing a primary pinch seal process, and 3(*e*) is a sectional view of a glass tube through the primary pinch seal process.
Figure 4:
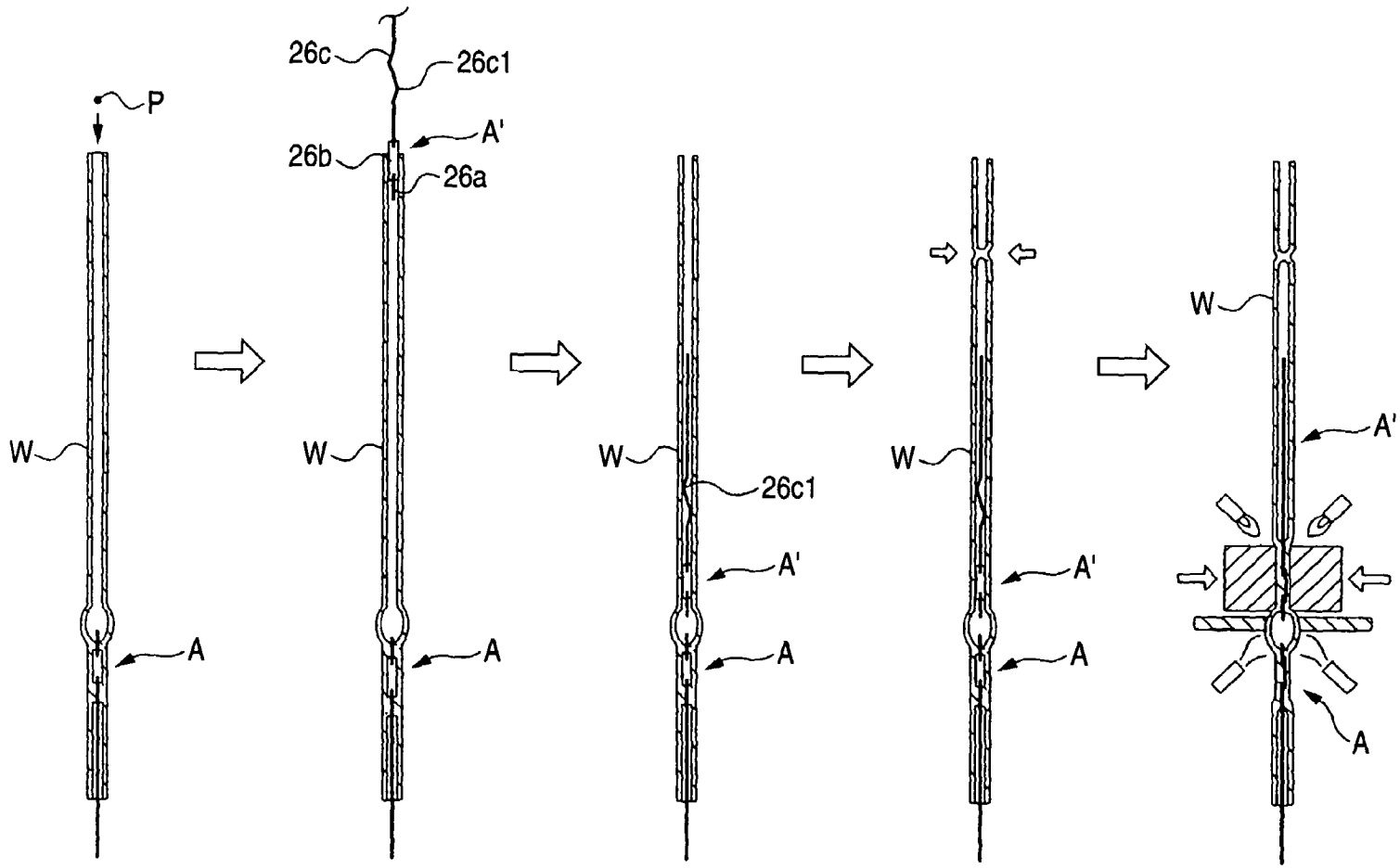
FIG. 4 is views explaining the second half of the manufacturing process of the discharge tube, and 4(*a*) is a view showing a pellet supply process, and 4(*b*) and 4(*c*) are views showing a conductor assembly insertion process, and 4(*d*) is a view showing a glass tube temporary seal process, and 4(*e*) is a view showing a secondary pinch seal process.
Figure 5:
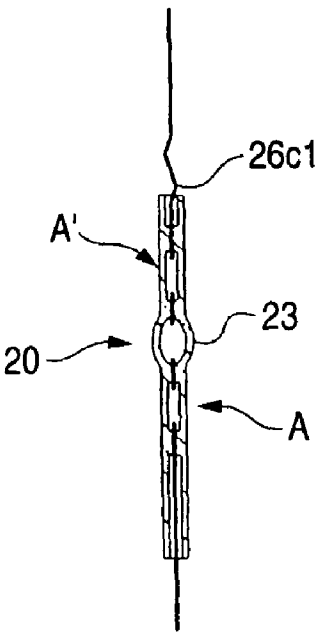
FIG. 5 is views explaining a shroud tube welding process, and 5(*a*) is a sectional view of the discharge tube before welding of the shroud tube, and 5(*b*) and 5(*c*) are views showing the shroud tube welding process.
Figure 5:
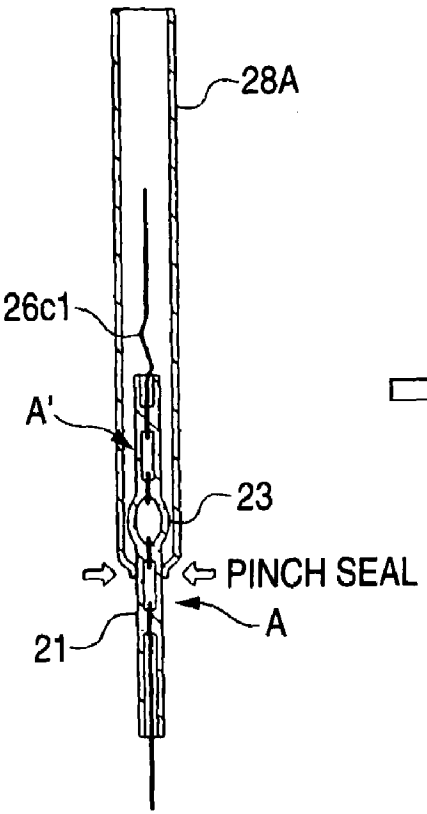
Figure 5:
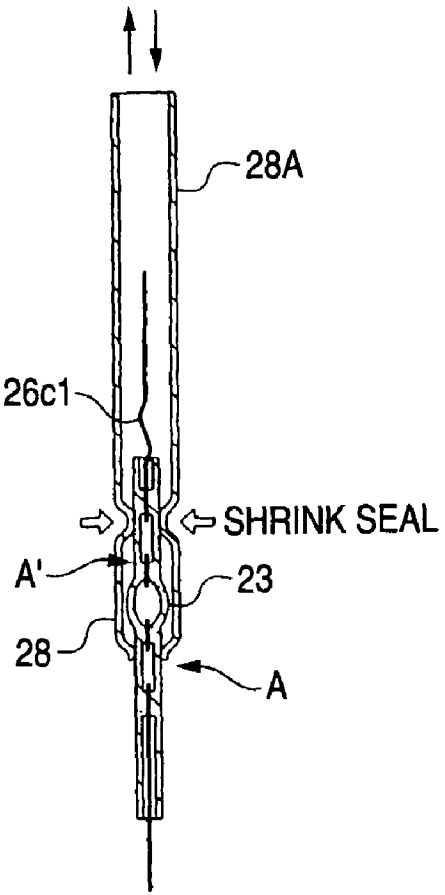

FIGS. 3 to 5 are process explanatory diagrams showing a welding process of a shroud and manufacture of the discharge tube 20. In JP-A-2002-163980, JP-A-2005-327487, etc., a welding process of a shroud and a manufacturing process of a high-intensity discharge tube (arc tube) widely used as a light source of a head lamp etc. for automobile are disclosed, that is, the process of manufacturing a high-intensity discharge tube (arc tube) with a double end shape in which both ends of a glass tube in which an ellipse spherical bulged part is formed in the middle of a longitudinal direction are pinched and sealed and thereby electrode assemblies are sealed and attached to respective pinch seal parts and the inside of the ellipse spherical bulged part forms discharge space and further welding a shroud to the pinch seal parts of the high-intensity discharge tube (arc tube) so as to surround this high-intensity discharge tube (arc tube) is disclosed, and the welding process of the shroud and manufacture of the discharge tube 20 shown in FIGS. 3 to 5 is a manufacturing method using manufacturing equipment of this high-intensity discharge tube (arc tube).

First, as shown in FIGS. 3(*a*) and 3(*b*), a glass tube W is heated by a burner and an ellipse spherical bulged part 23 is molded by blow molding in a predetermined position of a longitudinal direction of the glass tube. Next, as shown in FIGS. 3(*c*) and 3(*d*), a conductor assembly A in which a tungsten-made conductor bar 25*a*, molybdenum foil 25*b* and a molybdenum-made conductor bar 26*c* are linearly connected and integrated is inserted into the glass tube W and is held in a predetermined position and is heated by the burner and a position of the vicinity of the ellipse spherical bulged part 23 is pinched and sealed (primarily pinched and sealed). Specifically, the glass tube W to which the conductor assembly A is sealed and attached is completed by performing the temporary pinch seal shown in FIG. 3(*c*) followed by the main pinch seal shown in FIG. 3(*d*) (see FIG. 3(*e*)).

Then, as shown in FIG. 4(*a*), a pellet P of a light emission substance etc. is introduced into the glass tube W and further as shown in FIGS. 4(*b*) and 4(*c*), a conductor assembly A' in which a tungsten-made conductor bar 26*a*, molybdenum foil 26*b* and a molybdenum-made conductor bar 26*c* are linearly connected and integrated is inserted into the glass tube W and is held in a predetermined position. The molybdenum-made conductor bar 26*c* is provided with a bend part 26*c*1 with a width larger than an inside diameter of the glass tube W and the bend part 26*c*1 makes pressure contact with an inner peripheral surface of the glass tube W and thereby the conductor assembly A' is self-held in a predetermined position of the inside of the glass tube W. Then, as shown in FIG. 4(*d*), the light emission substance etc. are sealed inside the tube W by chipping off the glass tube W in a predetermined position while supplying a xenon gas to the inside of the glass tube W. Then, as shown in FIG. 4(*e*), while the ellipse spherical bulged part 23 is cooled by liquid nitrogen and the light emission substance etc. which are an enclosure substance are condensed and the inside of the tube is held at a negative pressure, a position of the vicinity of the ellipse spherical bulged part 23 is pinched and sealed (secondarily pinched and sealed) and the inside of the ellipse spherical bulged part 23 is sealed.

Then, a discharge tube 20 is completed by cutting the glass tube W in a predetermined position (see FIG. 5(*a*)). Then, as shown in FIG. 5(*b*), the discharge tube 20 is inserted into a shroud tube 28A and the back end (lower end) of the shroud tube 28A is heated by the burner and is welded to a pinch seal part 21. Then, as shown in FIG. 5(*c*), after performing gas replacement for exhausting air from the inside of the shroud tube 28A and supplying a dry inert gas, a predetermined position of the shroud tube 28A is heated by the burner and is shrunk and sealed. Finally, the discharge tube 20 (see FIG. 1) into which a shroud 28 is integrated is completed by cutting the discharge tube 20 into which the shroud tube 28A is integrated in a predetermined position.

Figure 6:
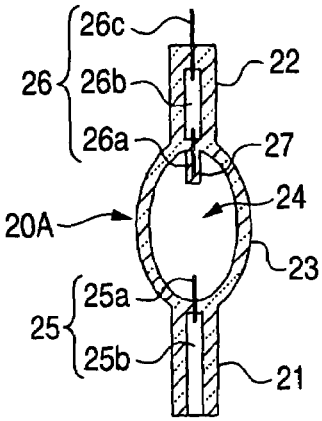
FIGS. 6(*a*) to 6(*f*) are diagrams respectively showing modified examples (other specifications) of the discharge tube which is a main part of the discharge lamp which is the first embodiment of the invention.
Figure 6:
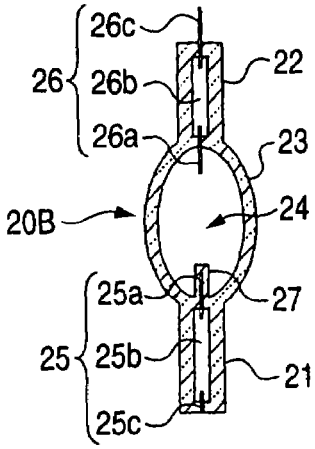
Figure 6:
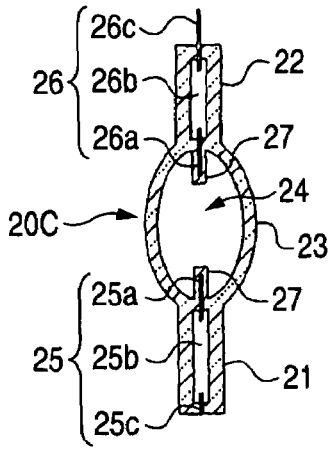
Figure 6:
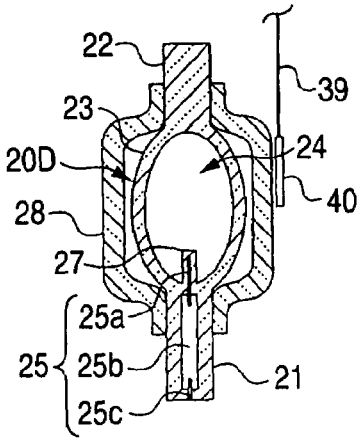
Figure 6:
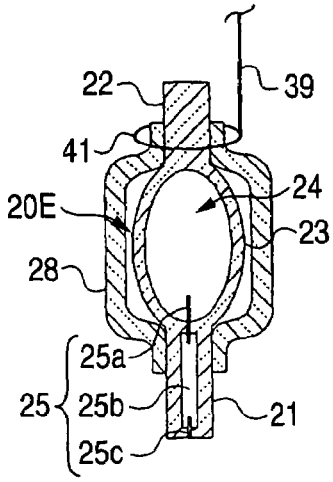
Figure 6:
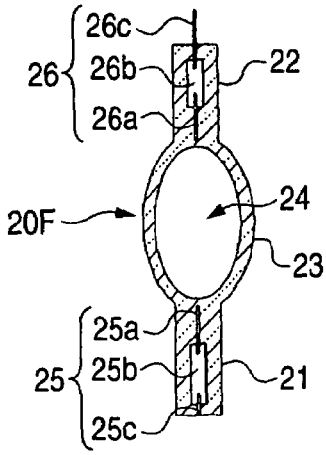

FIGS. 6(*a*) to 6(*f*) are diagrams respectively showing modified examples (other specifications) of the discharge tube 20 which is a main part of the discharge lamp which is the first embodiment of the invention.

In a discharge tube 20A shown in FIG. 6(*a*), a glass tube W is cut in a position including molybdenum foil 25*b* and the molybdenum foil 25*b* is exposed flush with an end face of a proximal side pinch seal part 21.

Also, a tungsten-made conductor bar 26*a* of the side of a distal side pinch seal part 22 protruding to the inside of discharge space 24 is covered with a glass cap part 27 extending from the pinch seal part 22.

In a discharge tube 20B shown in FIG. 6(*b*), a tungsten-made conductor bar 25*a* of a proximal side conductor assembly 25 protruding to discharge space 24 is covered with a glass cap part 27 extending from a pinch seal part 21.

In a discharge tube 20C shown in FIG. 6(*c*), tungsten-made conductor bars 25*a*, 26*a* protruding to the inside of discharge space 24 of conductor assemblies 25, 26 sealed and attached to pinch seal parts 21, 22 are respectively covered with glass cap parts 27.

Discharge tubes 20D, 20E shown in FIGS. 6(*d*) and 6(*e*) have a structure in which a conductor assembly 26 is not sealed and attached to a distal side pinch seal part 22, and in the discharge tube 20D, a tungsten-made conductor bar 25*a* of a proximal side conductor assembly 25 protruding to discharge space 24 is covered with a glass cap part 27 extending from a pinch seal part 21. Also, auxiliary electrodes for starting shown in FIGS. 6(*d*) and 6(*e*) are constructed of a conductor plate 40 and an annular conductor 41 arranged near to the distal side pinch seal part 22 of an ellipse spherical bulged part 23.

A discharge tube 20F shown in FIG. 6(*f*) has a structure in which conductor assemblies 25, 26 respectively sealed and attached to pinch seal parts 21, 22 are not exposed to the inside of discharge space 24 at all and do not protrude naturally.

Thus, the distal side conductor bar 26*a* of the discharge tube 20A, the proximal side conductor bar 25*a* of the discharge tube 20B, the proximal side conductor bar 25*a* and the distal side conductor bar 26*a* of the discharge tube 20C, the proximal side conductor bar 25*a* of the discharge tube 20D and the proximal side conductor bar 25*a* and the distal side conductor bar 26*a* of the discharge tube 20F are not exposed to the inside of the discharge space 24 directly, so that it is unnecessary to consider a reaction between the conductor bars 25*a*, 26*a* and an enclosure substance (for example, a metal halide) of the inside of the discharge space 24 and these conductor bars 25*a*, 26*a* may be constructed of molybdenum rather than tungsten.

Particularly, in the discharge tube 20C, the discharge tube 20D and the discharge tube 20F, the conductor bars 25*a*, 26*a* and the discharge space 24 are surely blocked by the glass cap part 27 or the pinch seal part, so that a desired substance such as a metal halide more effective in increasing light emission efficiency can be enclosed with the discharge space 24.

Figure 7:
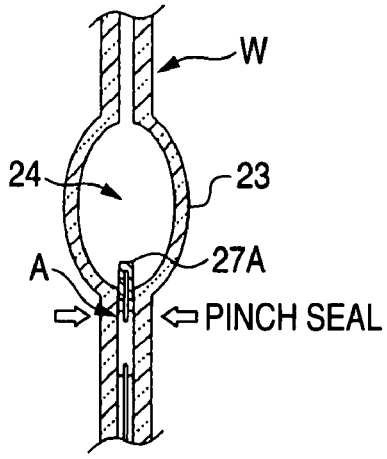
FIG. 7 is an explanatory view explaining a process of covering a conductor bar protruding to discharge space with a cap part.

Also, in order to obtain a structure in which regions protruding to discharge space 24 of the conductor bars 25*a*, 26*a* are covered with the glass cap part 27, the glass cap part 27 is welded in the pinch seal process shown in FIGS. 3(*d*) and 4(*e*). For example, in the primary pinch seal process, it is constructed so that the tungsten-made conductor bar 25*a* of the conductor assembly A inserted into the glass tube W is previously covered with a glass cap 27A and the conductor assembly A covered with the cap 27A is inserted into the glass tube W and is held in a predetermined position and the glass tube W together with the proximal side of the cap 27A are pinched and sealed as shown in FIG. 7. Also, in the secondary pinch seal process of inserting the conductor assembly A' in the glass tube W with the tungsten-made conductor bar 26*a* directed downward, prevention of a drop of the covered cap 27A from the conductor bar 26*a* is required but, for example, the drop prevention can be solved by slightly bending the tungsten-made conductor bar 26*a* covered with the cap 27A.

In addition, as another construction of blocking the conductor bars 25*a*, 26*a* and the discharge space 24, it may be constructed so as to cover outer surfaces of the conductor bars 25*a*, 26*a* with a ceramic coating ($Al_2O_3$, $SiO_2$, etc.) instead of covering the regions protruding to the discharge space 24 of the conductor bars 25*a*, 26*a* with the glass cap part 27, and in the case of being constructed thus, the need for the troublesome process shown in FIG. 7 is eliminated.

Figure 8:
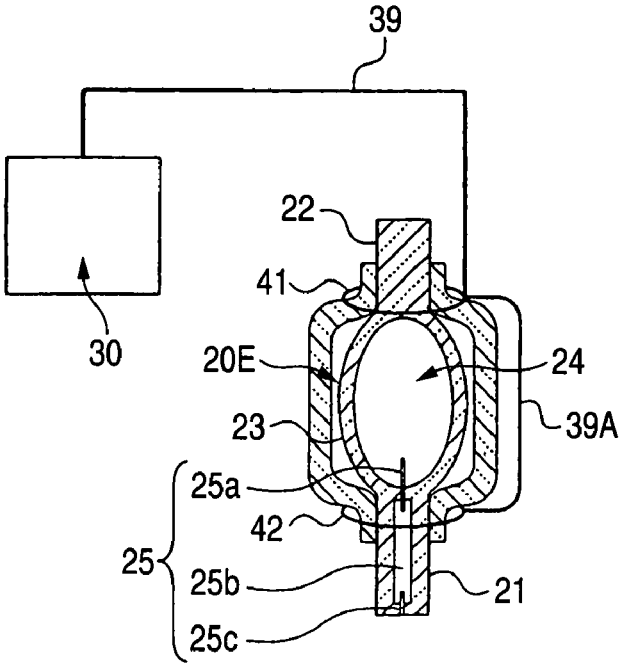
FIG. 8 is a diagram showing a modified example of an auxiliary electrode for starting which is a main part of the discharge lamp which is the first embodiment of the invention.

FIG. 8 shows a modified example of an auxiliary electrode for starting which is a main part of the discharge lamp which is the first embodiment of the invention, and the auxiliary electrode for starting is constructed of a pair of annular conductors 41, 42 which are arranged near to a proximal side pinch seal part 21 and near to a distal side pinch seal part 22 of an ellipse spherical bulged part 23 and are mutually connected by a lead wire 39A.

Figure 9:
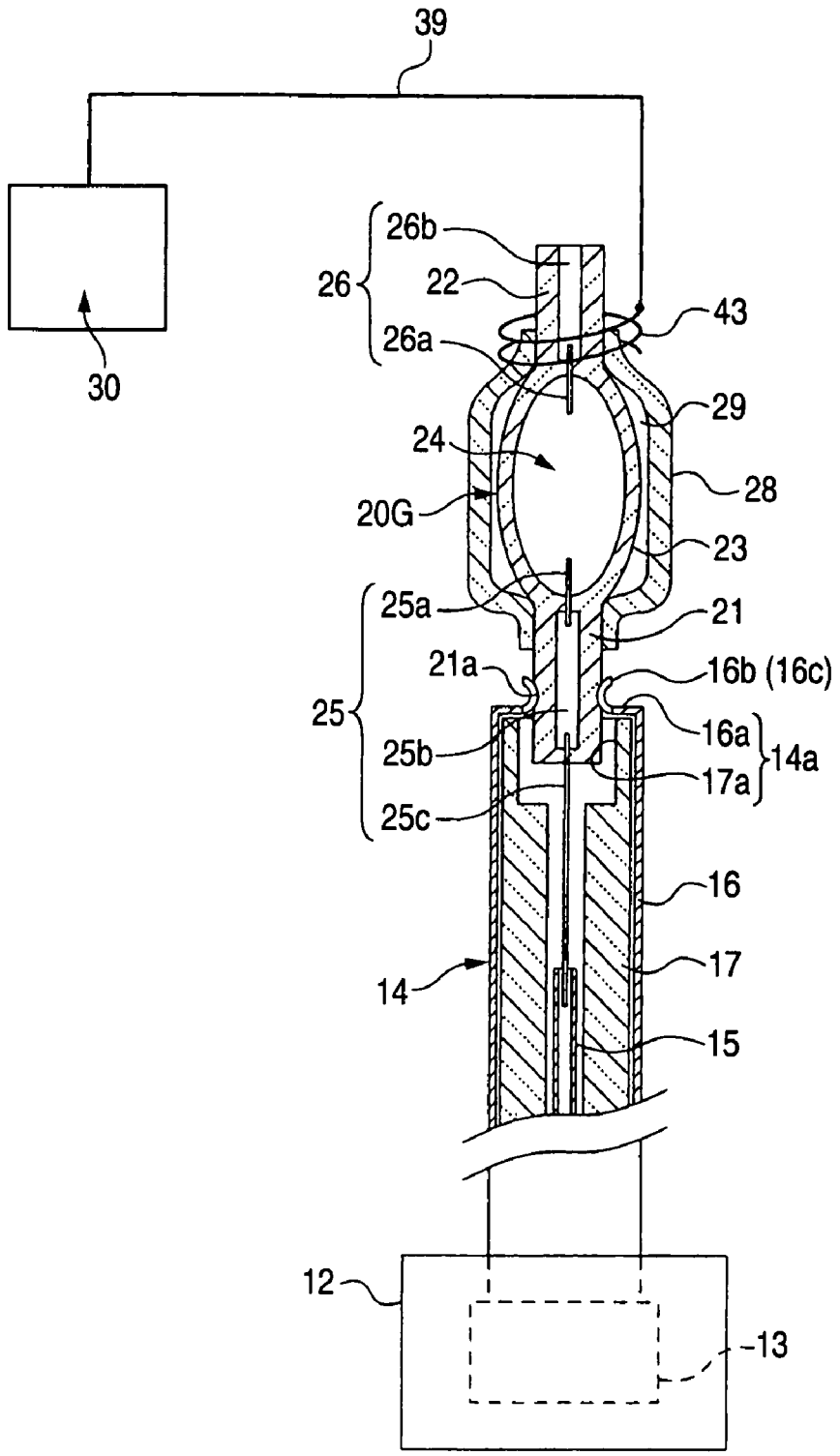
FIG. 9 is a longitudinal sectional view showing an outline of a discharge lamp which is a second embodiment of the invention.

FIG. 9 is a longitudinal sectional view showing an outline of a discharge lamp which is a second embodiment of the invention.

In the first embodiment described above, the molybdenum-made conductor bar 25*c* is exposed flush with an end face of the proximal side pinch seal part 21 of the discharge tube 20, but this second embodiment has a structure in which a molybdenum-made conductor bar 25*c* straight extends from a proximal side pinch seal part 21 of a discharge tube 20G.

Also, in a circular pipe-shaped dielectric 17 of the inside of a waveguide 14, an opening 17*a* for engagement with the proximal side pinch seal part 21 of the discharge tube 20G is formed in the top of the dielectric 17 and also an internal conductor 15 disposed inside the dielectric 17 is formed in a circular pipe shape having an inside diameter of a size capable of inserting the molybdenum-made conductor bar 25*c*.

Also, four tongue-shaped pinch pieces 16*b* which are discharge tube fixing and holding means with a structure similar to that of the tongue-shaped pinch pieces 15*a* formed in the top of the internal conductor 15 in the first embodiment are formed in the top of an external conductor 16 of the waveguide 14. That is, circular arc-shaped latch parts 16*c* capable of engaging with recessed grooves 21*a* of the pinch seal part 21 are formed in the four tongue-shaped pinch pieces

16*b* disposed as opposed to four corners of the proximal side pinch seal part 21 of the discharge tube 20G.

Then, when the proximal side pinch seal part 21 of the discharge tube 20G is inserted in a top opening 14*a* of the waveguide 14 (the top opening 17*a* of the dielectric 17) so as to push the tongue-shaped pinch pieces 16*b*, it is constructed so that the latch parts 16*c* of the tongue-shaped pinch pieces 16*b* engage with the recessed grooves 21*a* of the pinch seal part 21 and thereby the pinch seal part 21 is gripped (pinched) in the tongue-shaped pinch pieces 16*b* and is positioned and fixed and held in axial and circumferential directions (the discharge tube 20G is retained and fixed and held in the top opening 14*a* of the waveguide 14) and also the top of the molybdenum-made conductor bar 25*c* extending from the proximal side pinch seal part 21 is inserted into the circular pipe-shaped internal conductor 15 disposed inside the dielectric 17 and approaches the internal conductor 15.

Also, an auxiliary electrode for starting to which a high-voltage pulse generated by a high-voltage pulse generator 30 is applied is constructed of a coil-shaped conductor 43 arranged in the periphery of a distal side pinch seal part 22.

The others are the same as the first embodiment and the overlap description is omitted by assigning the same numerals.

Figure 10:
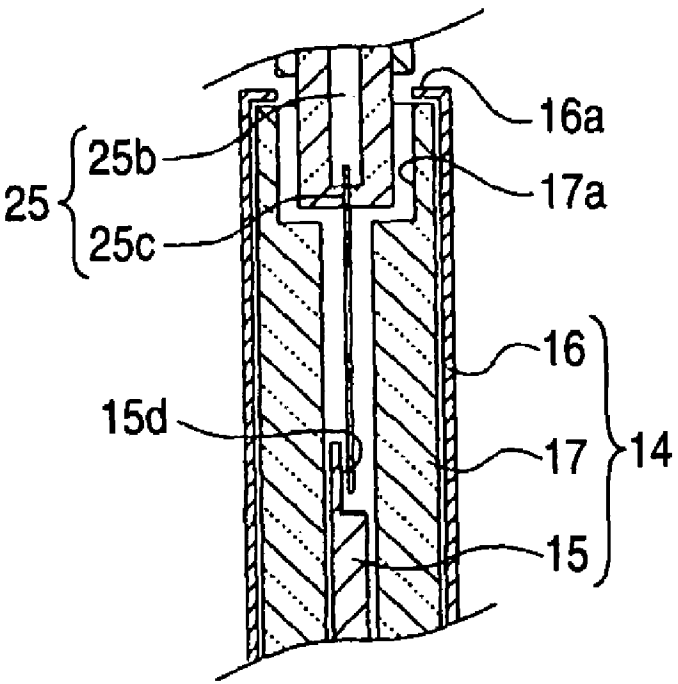
FIG. 10 is a longitudinal sectional view showing a modified example of an internal conductor constructing a waveguide of the same discharge lamp.
Figure 10:
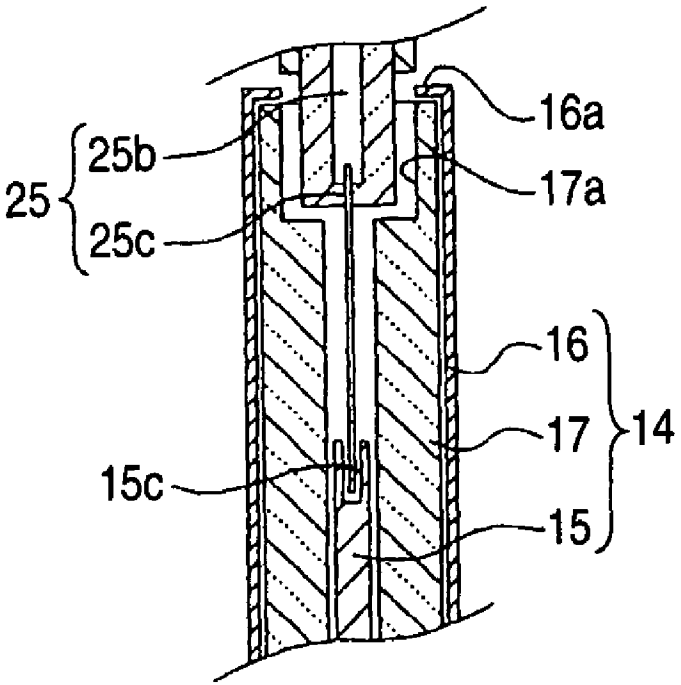

In addition, in this second embodiment, the internal conductor 15 constructing the waveguide 14 is constructed in a circular pipe shape, but a configuration in which the internal conductor 15 is constructed of a bar-shaped solid body and the top of the solid body is provided with a hole 15*c* capable of inserting the top of the molybdenum-made conductor bar 25*c* extending from the proximal side pinch seal part 21 as shown in FIG. 10(*a*) or a configuration in which the internal conductor 15 is constructed of a bar-shaped solid body and the side of the solid body is provided with a notch 15*d* capable of closely arranging the top of the molybdenum-made conductor bar 25*c* extending from the proximal side pinch seal part 21 as shown in FIG. 10(*b*) may be used.

Figure 11:
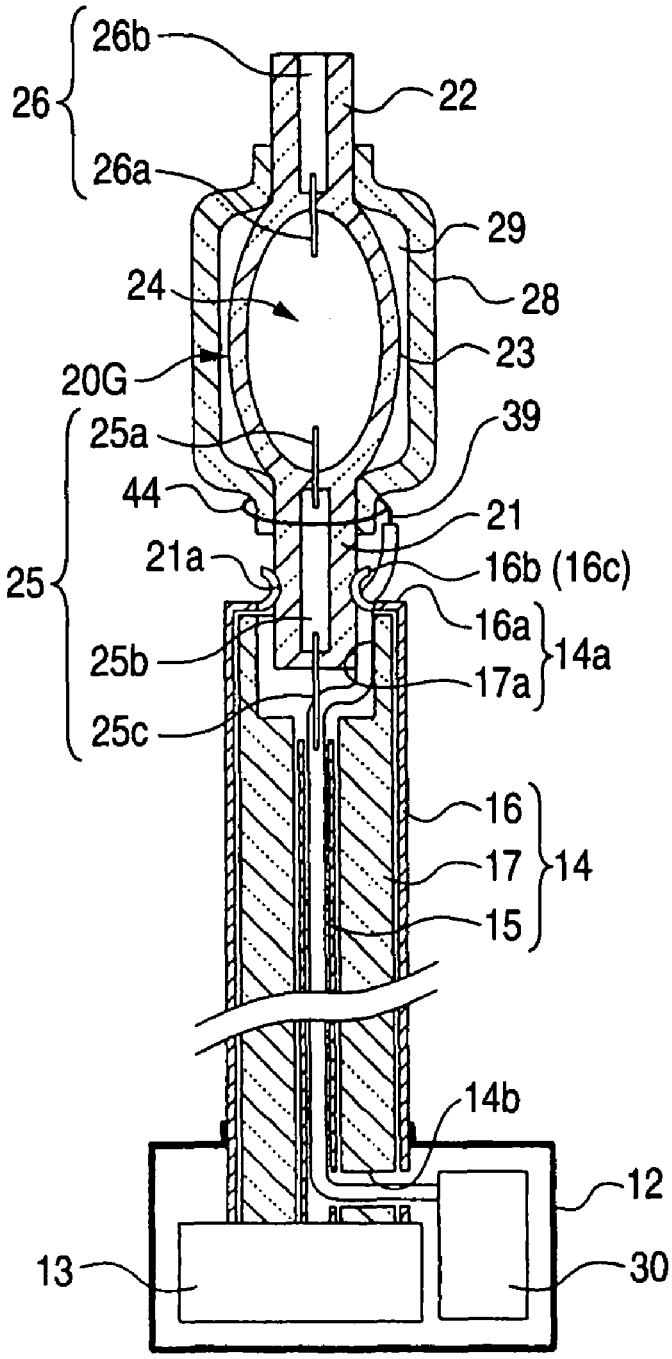
FIG. 11 (*a*) is a longitudinal sectional view showing an outline of a discharge lamp which is a third embodiment of the invention, and FIG. 11 (*b*) is a longitudinal sectional view showing an outline of a discharge lamp which is a fourth embodiment of the invention.
Figure 11:
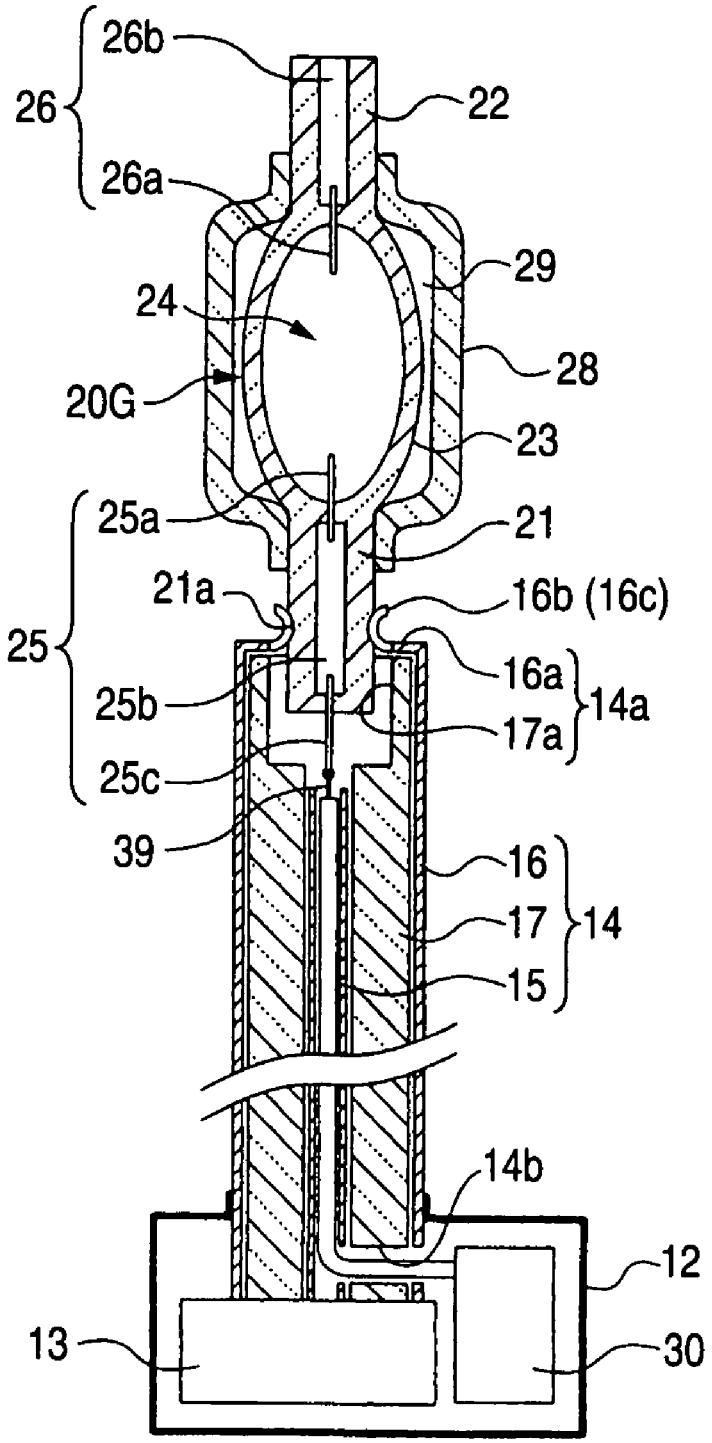

FIGS. 11(*a*) and 11(*b*) are longitudinal sectional views showing outlines of discharge lamps which are third and fourth embodiments of the invention.

In the third embodiment shown in FIG. 11(*a*), a high-voltage pulse generator 30 is disposed adjacently to a sending part 13 of the inside of a power source part 12, and a harness (lead wire 39) which is a pulse transmission line extending from the high-voltage pulse generator 30 is guided and inserted into a circular pipe-shaped internal conductor 15 from a hole 14*b* disposed in a waveguide 14 and is connected to an annular conductor 44 which is an auxiliary electrode for starting arranged in the periphery of a proximal side pinch seal part 21 of a discharge tube 20.

The others are the same as the discharge lamp (see FIG. 9) of the second embodiment, so that the overlap description is omitted by assigning the same numerals.

The fourth embodiment shown in FIG. 11(*b*) is constructed so that a harness (lead wire 39) which is a pulse transmission line extending from a high-voltage pulse generator 30 is guided and inserted into a circular pipe-shaped internal conductor 15 from a hole 14*b* disposed in a waveguide 14 and is connected to a molybdenum-made conductor bar 25*c* of a conductor assembly 25 extending from a proximal side pinch seal part 21 of a discharge tube 20 and the proximal side conductor assembly 25 constructing an electromagnetic wave irradiation part in cooperation with an external conductor 16 also functions as an auxiliary electrode for starting.

As a result of this, starting performance of the high-frequency discharge lamp can be increased without newly adding the auxiliary electrode for starting in the vicinity of the discharge tube 20.

The others are the same as the third embodiment shown in FIG. 11(*a*), so that the overlap description is omitted by assigning the same numerals.

Figure 12:
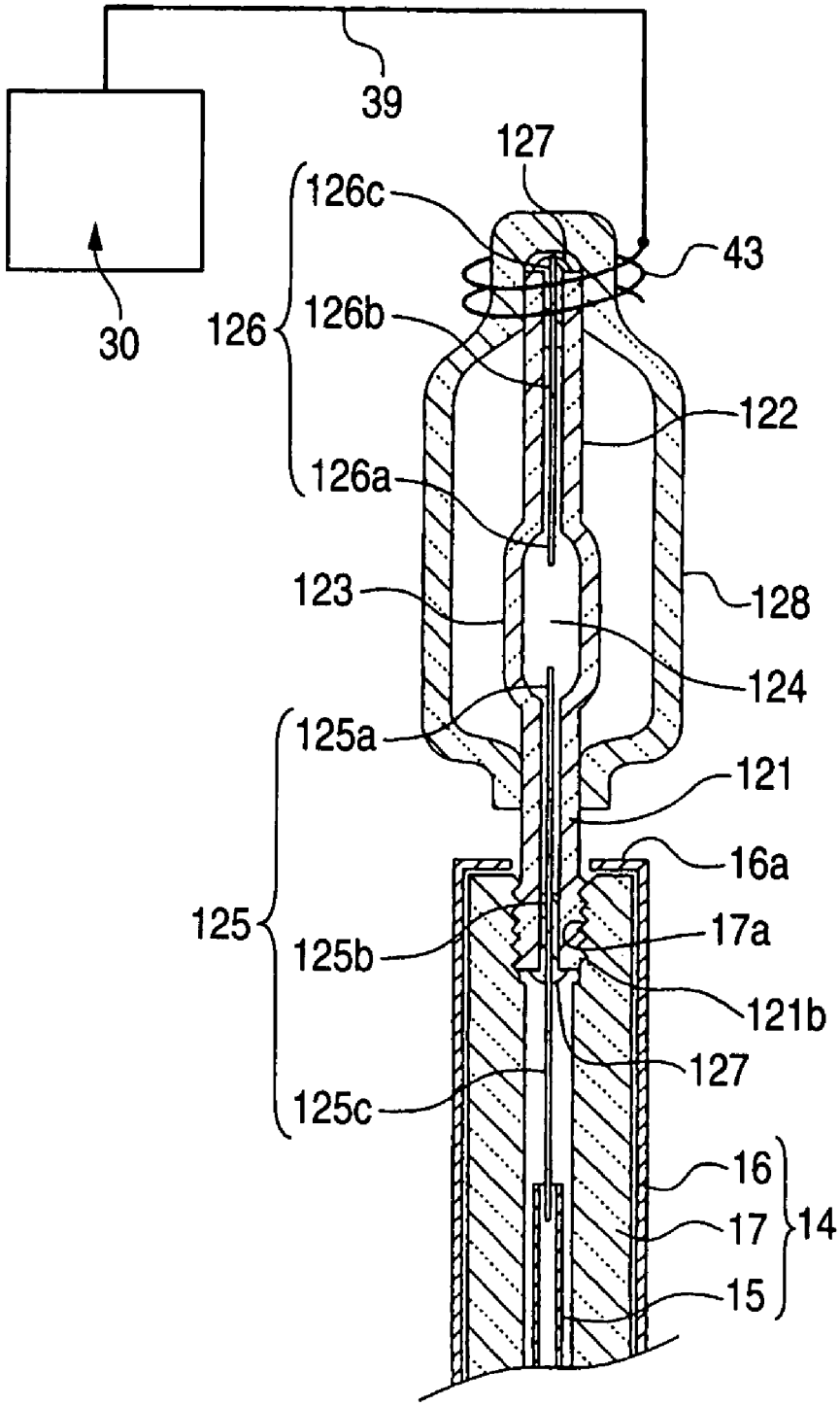
FIG. 12 is a longitudinal sectional view of a main part of a discharge lamp which is a fifth embodiment of the invention.
Figure 13:
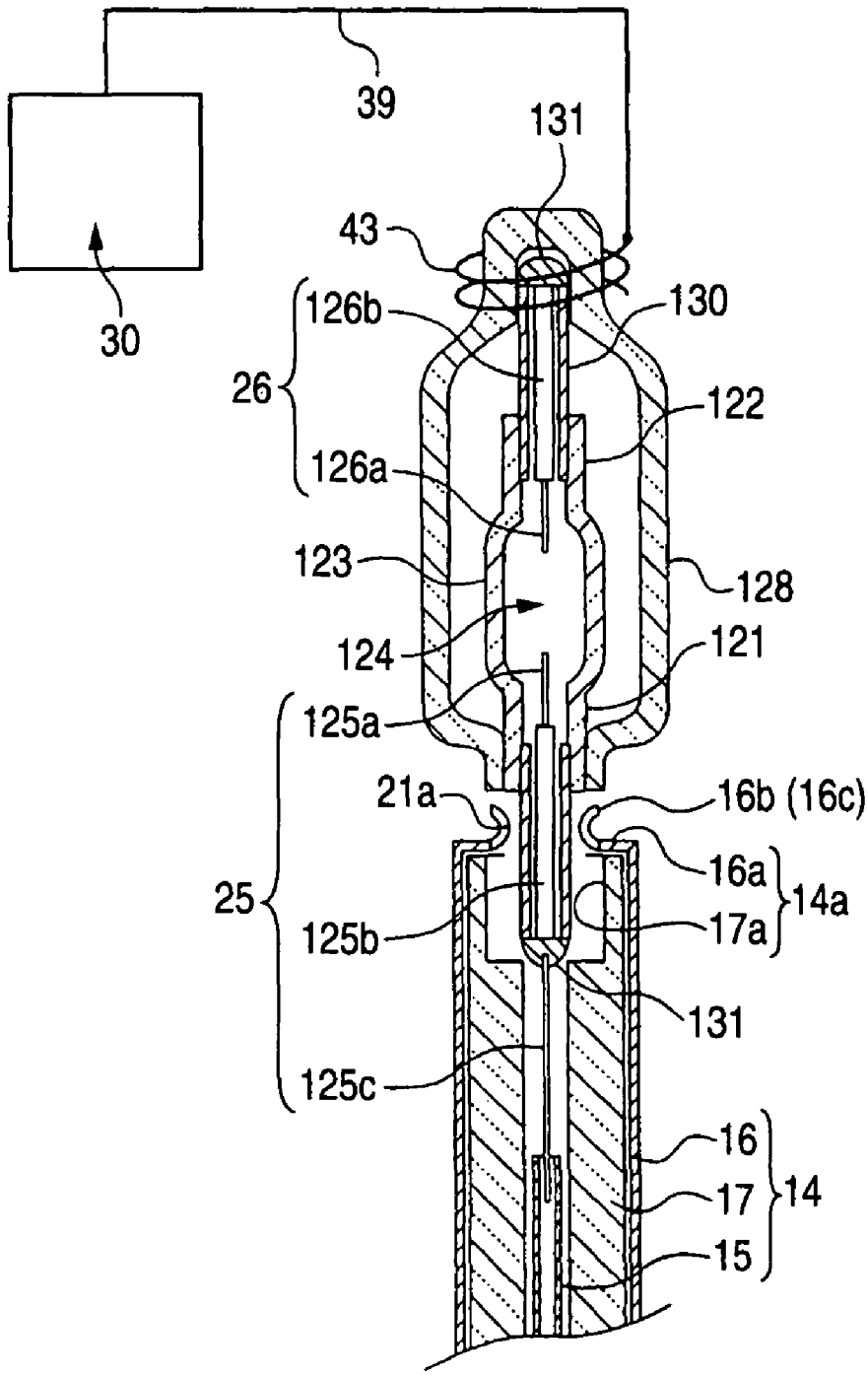
FIG. 13 is a longitudinal sectional view of a discharge tube which is a main part of a discharge lamp which is a sixth embodiment of the invention.
Figure 14:
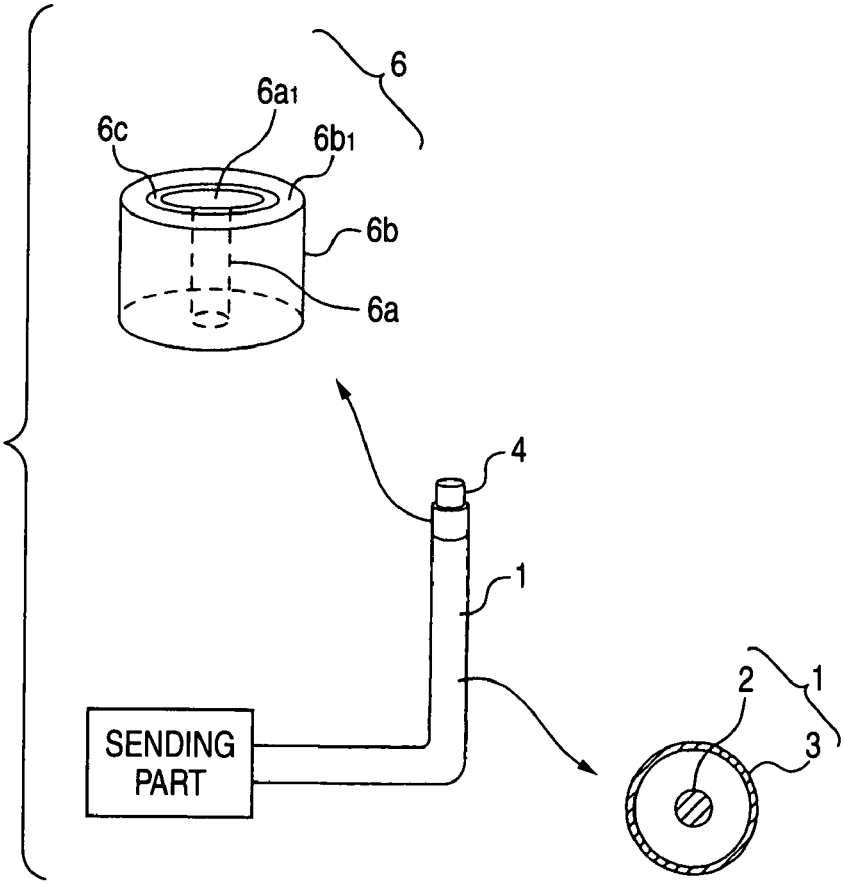
FIG. 14 is the whole configuration diagram of a conventional discharge lamp.

FIGS. 12 and 13 are longitudinal sectional views showing outlines of discharge lamps which are fifth and sixth embodiments of the invention.

In the first to fourth embodiments, the discharge tube is constructed of a quartz glass tube, but the fifth and sixth embodiments have a feature of constructing a discharge tube 120 of a ceramic tube.

That is, in the fifth embodiment shown in FIG. 12, molybdenum pipes 130, 130 are fixed by a metallization joint inside narrow tube parts 121, 122 of both ends of a ceramic tube in which an approximately ellipse spherical bulged part 123 is formed in the middle of a longitudinal direction and also, conductor assemblies 125, 126 in which tungsten conductor bars 125*a*, 126*a* and molybdenum conductor bars 125*b*, 126*b* are linearly integrated are inserted into the molybdenum pipes 130, 130 and also, the molybdenum conductor bars 125*b*, 126*b* are welded to the opening ends of the molybdenum pipes 130. A nickel conductor bar 125*c* inserted into an internal conductor 15 of a waveguide 14 is coaxially welded and fixed to a weld part 131 of the end of the molybdenum pipe 130 of the proximal side. That is, the weld part 131 for sealing the narrow tube parts 121, 122 constructs a seal attachment part of the discharge tube 120.

In the inside of the approximately ellipse spherical bulged part 123 (discharge space 124) with which a rare gas (1 to 20 atmospheric pressures at room temperature) for starting together with a light emission substance (NaI, ScI3, etc.) is enclosed, the tungsten conductor bars 125*a*, 126*a* of the top sides of the conductor assemblies 125, 126 supported in the weld part 131 which is the seal attachment part of the ceramic tube protrude by predetermined lengths and are opposed. Also, a molybdenum bar-shaped body 125*c* extending coaxially is welded and fixed to the proximal side weld part 131.

Numeral 128 is a cap type shroud made of quartz glass having ultraviolet blocking action covering the discharge tube 120, and the top (protrusion end of the molybdenum pipe 130) of the discharge tube 120 is engaged in a recessed part 129 disposed inside a vertex part of the shroud 128 and a proximal side opening of the shroud 128 is shrunk and sealed in an outer periphery surface of the proximal side narrow tube part 121 of the discharge tube 120 and thereby the shroud is integrated into the discharge tube 120.

Also, it is constructed so that tongue-shaped pinch pieces 16*a* which are discharge tube fixing and holding means formed in the top of the waveguide 14 (external conductor 16) can pinch (grip) the proximal outer periphery of the shroud 128. Then, it is arranged so that the discharge tube 120 is attached to the top of the waveguide 14 by being pinched (gripped) in the tongue-shaped pinch pieces 16*a* and also the molybdenum conductor bar 125*c* extending from the discharge tube 120 is inserted into the internal conductor 15 of the waveguide 14.

The others are the same as the second embodiment (see FIG. 9), so that the overlap description is omitted by assigning the same numerals.

A discharge tube 120A of the sixth embodiment shown in FIG. 13 is also constructed of a ceramic tube in a manner similar to the discharge tube 120 of the fifth embodiment, but this discharge tube 120A differs from the discharge tube 120 in that conductor assemblies 125, 126 inserted in narrow tube parts 121, 122 are integrally joined to the opening ends of the narrow tube parts 121, 122 by frit seal. Numeral 127 shows a glass weld part.

That is, the conductor assemblies 125, 126 have a structure of linearly integrating tungsten conductor bars 125*a*, 126*a*, molybdenum conductor bars 125*b*, 126*b* and niobium conductor bars 125*d*, 126*d*, and the niobium conductor bars 125*d*, 126*d* of the conductor assemblies 125, 126 are integrated into the opening ends of the narrow tube parts 121, 122 by glass welding. The niobium conductor bar 125*d* of the back end side of the conductor assembly 125 straight extends from the proximal side narrow tube part 121 of the discharge tube 120A.

It is arranged so that while an internal thread part 17*b* is formed in the inner periphery of an opening of a circular pipe-shaped dielectric 17, an external thread part 121*b* is formed in the outer periphery of the proximal side narrow tube part 121 of the discharge tube 120A and by screwing the proximal side narrow tube part 121 of the discharge tube 120A into an opening 17*a* of the dielectric 17, the discharge tube 120A is attached (fixed and held) to the top of a waveguide 14 and the niobium conductor bar 125*d* of the back end side of the conductor assembly 125 extending from the discharge tube 120A is inserted into an internal conductor 15 of the waveguide 14.

The others are the same as the fifth embodiment (see FIG. 12), so that the overlap description is omitted by assigning the same numerals.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF THE REFERENCE NUMERALS AND SIGNS

A FIRST CONDUCTOR ASSEMBLY
A' SECOND CONDUCTOR ASSEMBLY
W GLASS TUBE
14 COAXIAL WAVEGUIDE
15 INTERNAL CONDUCTOR
15*a* TONGUE-SHAPED PINCH PIECE WHICH IS DISCHARGE TUBE FIXING AND HOLDING MEANS DISPOSED IN INTERNAL CONDUCTOR
16 EXTERNAL CONDUCTOR
16*b* TONGUE-SHAPED PINCH PIECE WHICH IS DISCHARGE TUBE FIXING AND HOLDING MEANS DISPOSED IN EXTERNAL CONDUCTOR
17 DIELECTRIC
20, 20A to 20G DISCHARGE TUBE
21 PROXIMAL SIDE PINCH SEAL PART WHICH IS SEAL ATTACHMENT PART OF DISCHARGE TUBE
22 DISTAL SIDE PINCH SEAL PART WHICH IS SEAL ATTACHMENT PART OF DISCHARGE TUBE
23 ELLIPTIC BULGED PART
24 DISCHARGE SPACE
25 FIRST CONDUCTOR ASSEMBLY
26 SECOND CONDUCTOR ASSEMBLY WHICH IS AUXILIARY ELECTRODE FOR STARTING
25*a*,26*a* TUNGSTEN-MADE CONDUCTOR BAR
25*b*,26*b* MOLYBDENUM FOIL
25*c*,26*c* MOLYBDENUM-MADE CONDUCTOR BAR
27 GLASS CAP PART
27A GLASS CAP
28 SHROUD
28A SHROUD TUBE
30 HIGH-VOLTAGE PULSE GENERATOR
31 DC POWER SOURCE
39 LEAD WIRE WHICH IS PULSE TRANSMISSION LINE
40,41,42,43 CONDUCTOR WHICH IS AUXILIARY POWER SOURCE FOR STARTING
120,120A DISCHARGE TUBE
123 APPROXIMATELY ELLIPSE SPHERICAL BULGED PART
124 DISCHARGE SPACE
125 CONDUCTOR ASSEMBLY
126 CONDUCTOR ASSEMBLY
130 MOLYBDENUM PIPE
17*b*,121*b* THREAD PARTS WHICH ARE DISCHARGE TUBE FIXING AND HOLDING MEANS DISPOSED IN INNER PERIPHERY OF DIELECTRIC AND OUTER PERIPHERY OF NARROW TUBE PART
127 GLASS WELD PART WHICH IS SEAL ATTACHMENT PART OF DISCHARGE TUBE
131 WELD PART WHICH IS SEAL ATTACHMENT PART OF DISCHARGE TUBE

What is claimed is:

1. A high-frequency discharge lamp comprising
a coaxial waveguide for high-frequency electromagnetic wave transmission
wherein the coaxial waveguide comprises
an internal conductor and
a pipe-shaped external conductor surrounding said internal conductor, and
a discharge tube for emitting light of discharge by plasma generated by electromagnetic waves,
wherein the discharge tube
is attached to the top of the waveguide, and
is constructed in a double end shape in which both ends of a ceramic tube or a glass tube are pinched and sealed,
wherein the ceramic tube or the glass tube comprises an approximately ellipse spherical bulged part formed in a middle of a longitudinal direction,
wherein a conductor assembly is sealed and attached to at least a proximal side seal attachment part,
wherein a rare gas for starting with 1 atmospheric pressure or more at room temperature together with a light emission substance is enclosed inside of the approximately ellipse spherical bulged part,
wherein an electromagnetic wave irradiation part is constructed by the conductor assembly and the external conductor top of the coaxial waveguide surrounding said conductor assembly by inserting and holding the proximal side seal attachment part of the discharge tube in a top opening of the coaxial waveguide so that the conductor assembly approaches the internal conductor of the waveguide, and
wherein an auxiliary electrode for starting to which a high-voltage pulse generated by a high-voltage pulse generator is applied through a pulse transmission line is disposed near the approximately ellipse spherical bulged part of the discharge tube.

2. The high-frequency discharge lamp as claimed in claim 1, wherein the auxiliary electrode for starting is constructed by a conductor assembly sealed and attached to a distal side seal attachment part of the discharge tube.

3. The high-frequency discharge lamp as claimed in claim 1, wherein the auxiliary electrode for starting is constructed by a conductor assembly sealed and attached to a proximal side seal attachment part of the discharge tube.

4. The high-frequency discharge lamp as in claim 1, wherein the approximately ellipse spherical bulged part is covered with hermetically sealed space defined by a cylindrical shroud for ultraviolet shielding integrally welded to the seal attachment part.

5. The high-frequency discharge lamp as in claim 4, wherein a gas capable of assisting discharge, the gas with less than 1 atmospheric pressure at room temperature, is enclosed inside of the hermetically sealed space surrounding the approximately ellipse spherical bulged part defined by the shroud.

6. The high-frequency discharge lamp as in claim 1, wherein the discharge tube is constructed of a quartz glass tube and the seal attachment part is constructed of a pinch seal part and a part of the conductor assembly sealed and attached to at least the proximal side pinch seal part among a pair of the pinch seal parts protrudes to the inside of the approximately ellipse spherical bulged part.

7. The high-frequency discharge lamp as claimed in claim 2, wherein the auxiliary electrode for starting is constructed by a conductor assembly sealed and attached to a proximal side seal attachment part of the discharge tube.

8. The high-frequency discharge lamp as in claim 2, wherein the approximately ellipse spherical bulged part is covered with hermetically sealed space defined by a cylindrical shroud for ultraviolet shielding integrally welded to the seal attachment part.

9. The high-frequency discharge lamp as in claim 3, wherein the approximately ellipse spherical bulged part is covered with hermetically sealed space defined by a cylindrical shroud for ultraviolet shielding integrally welded to the seal attachment part.

10. A high-frequency discharge lamp comprising:

a coaxial waveguide comprising an internal conductor and a pipe-shaped external conductor surrounding said internal conductor, and a discharge tube comprising:

a ceramic or glass tube having:

an approximately ellipse spherical bulged part formed in a middle of a longitudinal direction, and both ends pinched and sealed;

a conductor assembly sealed and attached to an end of the ceramic or glass tube; and an auxiliary electrode for starting disposed near the approximately ellipse spherical bulged part, wherein a rare gas for starting with 1 atmospheric pressure or more at room temperature together with a light emission substance is enclosed inside of the approximately ellipse spherical bulged part, wherein the discharge tube is inserted conductor assembly end first and held in a top opening of the coaxial waveguide, and wherein a high-voltage pulse generated by a high-voltage pulse generator is applied to the auxiliary electrode through a pulse transmission line.

11. The high-frequency discharge lamp as claimed in claim 10, wherein the auxiliary electrode for starting comprises a second conductor assembly sealed and attached to the other end of the ceramic or glass tube.

12. The high-frequency discharge lamp as claimed in claim 10, wherein the auxiliary electrode for starting is disposed on the end where the conductor assembly is sealed and attached.

13. The high-frequency discharge lamp as in claim 10, wherein the approximately ellipse spherical bulged part is covered with hermetically sealed space defined by a cylindrical shroud for ultraviolet shielding.

14. The high-frequency discharge lamp as in claim 10, wherein the discharge tube is constructed of a quartz glass tube and a part of the conductor assembly sealed and attached protrudes to inside of the approximately ellipse spherical bulged part.

15. A method of manufacturing a high-frequency discharge lamp comprising a coaxial waveguide and a discharge tube, the method comprising:

constructing the discharge tube by forming an approximately ellipse spherical bulged part in a middle of a longitudinal direction of a ceramic or glass tube, enclosing a rare gas for starting with 1 atmospheric pressure or more at room temperature together with a light emission substance inside of the approximately ellipse spherical bulged part, pinching and sealing both ends of the ceramic or glass tube, sealing and attaching a conductor assembly to an end of the ceramic or glass tube, and disposing an auxiliary electrode for starting near the approximately ellipse spherical bulged part;

constructing the coaxial waveguide with an internal conductor and a pipe-shaped external conductor surrounding said internal conductor;

adapting the coaxial waveguide to hold the discharge tube in a top opening thereof; and inserting the discharge tube conductor assembly end first into the top opening of the coaxial waveguide.

16. The method of manufacturing a high-frequency discharge lamp as claimed in claim 15, wherein the starting auxiliary electrode is constructed by sealing and attaching a second conductor assembly to the other end of the ceramic or glass tube.

17. The method of manufacturing a high-frequency discharge lamp as claimed in claim 15, wherein the auxiliary electrode for starting is constructed by the sealing and attaching of the conductor assembly to the end of the ceramic or glass tube.

18. The method of manufacturing a high-frequency discharge lamp as in claim 15, further comprising covering the ellipse spherical bulged part with hermetically sealed space defined by a cylindrical shroud for ultraviolet shielding.

19. The method of manufacturing a high-frequency discharge lamp as in claim 15, wherein the discharge tube is constructed of a quartz glass tube and a part of the conductor assembly sealed and attached protrudes to inside of the approximately ellipse spherical bulged part.

* * * * *